US008749840B2

(12) United States Patent
Udaka

(10) Patent No.: US 8,749,840 B2
(45) Date of Patent: Jun. 10, 2014

(54) IMAGE FORMING APPARATUS, IMAGE PROCESSOR, IMAGE PROCESSING METHOD AND COMPUTER READABLE MEDIUM

(75) Inventor: Tsutomu Udaka, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 996 days.

(21) Appl. No.: 12/543,137

(22) Filed: Aug. 18, 2009

(65) Prior Publication Data

US 2010/0238463 A1 Sep. 23, 2010

(30) Foreign Application Priority Data

Mar. 18, 2009 (JP) ..... 2009-066181

(51) Int. Cl.
*G06F 15/00* (2006.01)

(52) U.S. Cl.
USPC ..... 358/1.9; 358/535; 358/502; 358/504; 358/518; 358/1.18; 347/102; 347/9; 347/3; 347/12; 347/24

(58) Field of Classification Search
USPC ..... 358/1.9
See application file for complete search history.

(56) References Cited

U.S. PATENT DOCUMENTS

| | | | | |
|---|---|---|---|---|
| 5,767,870 | A * | 6/1998 | Klassen et al. | 347/9 |
| 6,519,055 | B1 * | 2/2003 | Curry et al. | 358/2.1 |
| 2006/0033806 | A1 * | 2/2006 | Nakagawa | 347/239 |
| 2009/0168109 | A1 * | 7/2009 | Kishi | 358/3.27 |

FOREIGN PATENT DOCUMENTS

| | | |
|---|---|---|
| JP | 5-027514 | 2/1993 |
| JP | 2003-084643 | 3/2003 |
| JP | 2003-263089 A | 9/2003 |
| JP | 2007-276270 A | 10/2007 |
| JP | 2009-046218 A | 3/2009 |

OTHER PUBLICATIONS

Office Action dated Nov. 16, 2012 from the Korean Patent Office in a counterpart Korean application.

* cited by examiner

*Primary Examiner* — Firmin Backer
*Assistant Examiner* — Brendan McCommas
(74) *Attorney, Agent, or Firm* — Morgan, Lewis & Bockius LLP

(57) ABSTRACT

An image forming apparatus includes: an image processing unit acquiring image data, performing image processing, and generating color image data for respective colors; plural toner image forming units each forming and developing an electrostatic latent image on the basis of the color image data, and forming a color toner image; and a toner image holding member moving while holding each color toner image. Each electrostatic latent image has pixel rows arranged in a slow scan direction, with pixels aligned in a fast scan direction. The image processing unit performs, on the color image data, image processing to add or delete the pixel rows for a position of the electrostatic latent image in the slow scan direction. The number of the pixel rows corresponds to the amount of change in a moving velocity of the toner image holding member when each color toner image formed at the position is held.

10 Claims, 20 Drawing Sheets

IMAGE FORMING APPARATUS, IMAGE PROCESSOR, IMAGE PROCESSING METHOD AND COMPUTER READABLE MEDIUM

CROSS REFERENCE TO RELATED APPLICATIONS

This application is based on and claims priority under 35 USC §119 from Japanese Patent Application No. 2009-066181 filed Mar. 18, 2009.

BACKGROUND

1. Technical Field

The present invention relates to an image forming apparatus, an image processor, an image processing method and a computer readable medium storing a program.

2. Related Art

Image forming apparatuses such as color copiers and color printers generally conduct a process in which color toner images are formed with sequential superimposition on an intermediate transfer body, for example, and in which the color toner images are collectively transferred from the intermediate transfer body onto a sheet. At this time, in order to prevent the sheet from being pulled between a collective transfer unit and sheet transporting members disposed around the collective transfer unit, the more upstream side a sheet transporting member is disposed, the faster the sheet transporting speed thereof is normally set. For this reason, the transporting speed of the intermediate transfer body changes due to force, in a sheet transporting direction, additionally applied to the intermediate transfer body from the sheet, hence causing color shifting in an image in some cases depending on a type of the sheet being used.

SUMMARY

According to an aspect of the present invention, there is provided an image forming apparatus including: an image processing unit that acquires image data, performs image processing on the image data, and generates pieces of color image data that are pieces of image data for respective colors; plural toner image forming units that each form an electrostatic latent image on the basis of one of the pieces of color image data generated by the image processing unit, that each develop the electrostatic latent image thus formed, and that each form a color toner image, the electrostatic latent image having pixel rows arranged in a slow scan direction, the pixel rows each including pixels aligned in a fast scan direction; and a toner image holding member that moves while holding each color toner image formed by each of the plural toner image forming units. The image processing unit performs, on each of the pieces of color image data, image processing that is any one of adding and deleting the pixel rows for a position, in the slow scan direction, of the electrostatic latent image to be formed on the basis of each of the pieces of color image data, the number of the pixel rows corresponding to the amount of change in a moving velocity of the toner image holding member when each color toner image formed at the position is held by the toner image holding member.

BRIEF DESCRIPTION OF THE DRAWINGS

Exemplary embodiment(s) of the present invention will be described in detail based on the following figures, wherein.

DETAILED DESCRIPTION

An exemplary embodiment of the present invention will be described below in detail with reference to the accompanying drawings.

<Description of Image Forming Apparatus>

Figure 1:
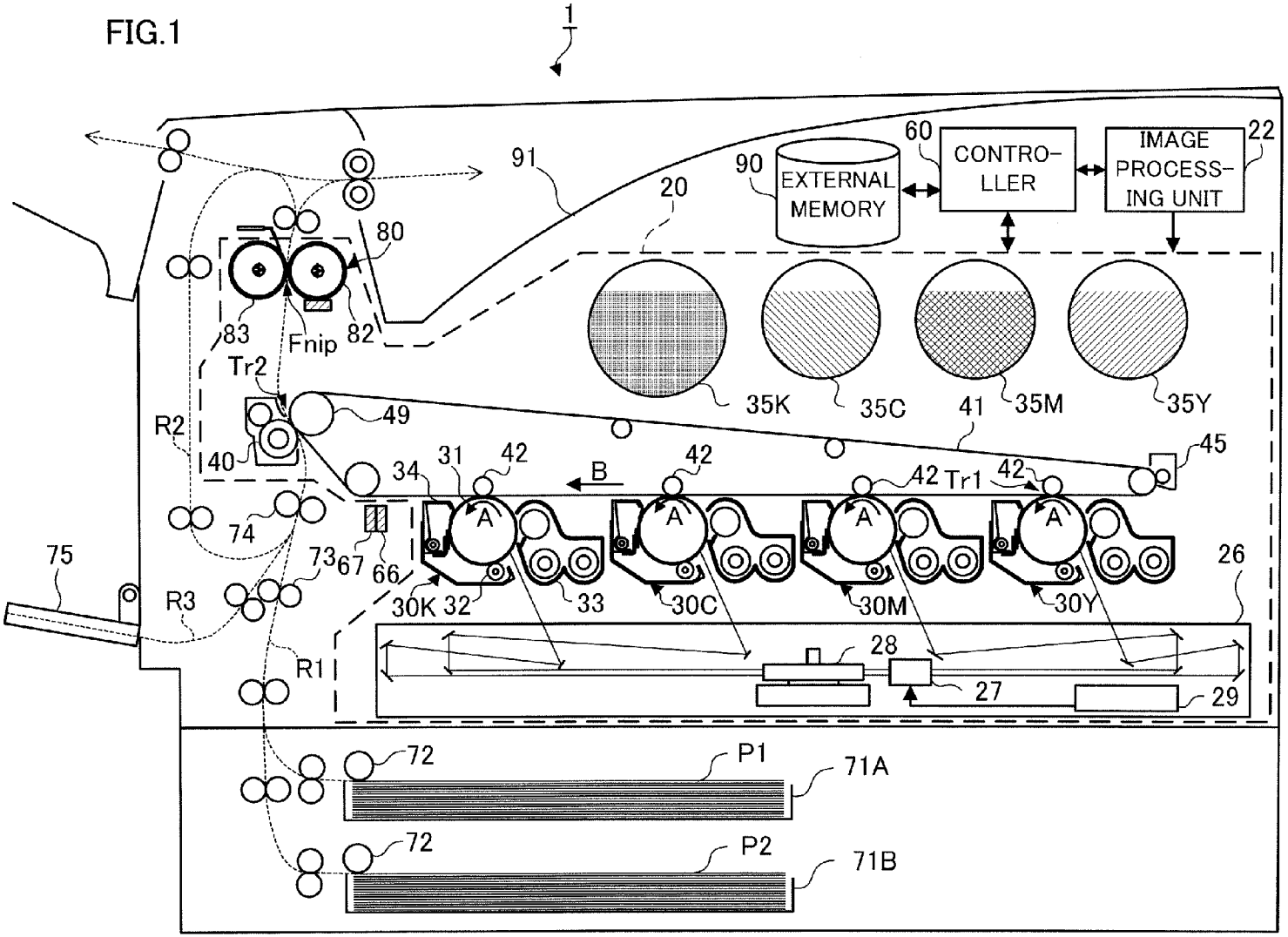
FIG. 1 is a diagram showing a configuration example of an image forming apparatus to which the exemplary embodiment is applied.

FIG. 1 is a diagram showing a configuration example of an image forming apparatus 1 to which the present exemplary embodiment is applied. The image forming apparatus 1 shown in FIG. 1 is a so-called tandem-type digital color printer. The image forming apparatus 1 includes: an image forming process unit 20 that forms a color image on the basis of image data; a controller 60 that controls operations of the entire image forming apparatus 1; an image processing unit 22 as an example of an image processing unit (image processor) that performs image processing on image data received, for example, from an image generating apparatus such as a personal computer (PC) or an image reading apparatus such as a scanner; and an external memory 90.

The image forming apparatus 1 also includes: a humidity sensor 66 that detects the humidity inside the apparatus; and a temperature sensor 67 that detects the temperature inside the apparatus.

The image forming process unit 20 includes four image forming units 30Y, 30M, 30C and 30K (collectively referred to as "image forming unit 30" hereinafter) that are arranged in parallel at regular intervals and that respectively form toner images of yellow (Y), magenta (M), cyan (C) and black (K). Note that, the image forming process unit 20 may include five or more color image forming units with additional one or more of color image forming units that form color toner images of, for example, light cyan (LC), light magenta (LM), a clear toner, a corporate color, and the like.

Each of the image forming units 30 includes: a photoconductor drum 31 that obtains an electrostatic latent image formed thereon while rotating in a direction of an arrow A; a charging roll 32 that uniformly charges the surface of the photoconductor drum 31 at a predetermined electric potential; a developing device 33 that develops the electrostatic latent image formed on the photoconductor drum 31; and a drum cleaner 34 that cleans the surface of the photoconductor drum 31 after a primary transfer. By use of the color toners of Y, M, C and K supplied from toner containers 35Y, 35M, 35C and 35K, respectively, the developing devices 33 arranged with the image forming units 30 develop the respective electrostatic latent images formed on the photoconductor drums 31.

In addition, the image forming process unit 20 includes: a laser exposure device 26; an intermediate transfer belt 41 as an example of a toner image holding member; primary transfer rolls 42; a secondary transfer roll 40; and a fixing device 80. The laser exposure device 26 exposes each of the photoconductor drums 31 provided in each of the image forming units 30 (one that uses an array of light-emitting elements such as LEDs or organic ELs may be employed). Onto the intermediate transfer belt 41, the multiple layers of color toner images formed on the respective photoconductor drums 31 of the respective image forming units 30 are transferred, and the intermediate transfer belt 41 holds and transports the multiple layers of color toner images thus transferred. The primary transfer rolls 42 sequentially transfer (primarily transfer) the color toner images of the image forming units 30 on the intermediate transfer belt 41 respectively at primary transfer portions Tr1. The secondary transfer roll 40 collectively transfers (secondarily transfers) the superimposed toner images, which have been transferred onto the intermediate transfer belt 41, onto a sheet P (P1 or P2) that is a recording medium (recording sheet), at a secondary transfer portion Tr2. The fixing device 80 fixes the secondarily transferred image on the sheet P.

The laser exposure device 26 includes: a semiconductor laser 27 as a light source; a scanning optical system (not illustrated) that scans and exposes each of the photoconductor drums 31 with laser light; a rotating polygon mirror (polygon mirror) 28 formed, for example, into a regular hexahedron; and a laser driver 29 that controls driving of the semiconductor laser 27. The laser driver 29 receives image data from the image processing unit 22, and a light amount control signal or the like from the controller 60. The laser driver 29 controls lighting, an output light amount and the like of the semiconductor laser 27.

The primary transfer rolls 42 are each supplied with a primary transfer bias voltage from a primary transfer power supply (not illustrated), and primarily transfer the color toner images onto the intermediate transfer belt 41. The secondary transfer roll 40 is supplied with a secondary transfer bias voltage from a secondary transfer power supply (not illustrated), and secondarily transfers the toner images on the sheet P.

The fixing device 80 includes: a fixing roll 82 that includes a heater therein; and a pressing roll 83 that is arranged to press the fixing roll 82. While the sheet P having an unfixed toner image thereon is transported through a nip portion Fnip formed between the fixing roll 82 and the pressing roll 83, the toner image is fixed onto the sheet P.

In such a image forming apparatus 1, the image processing unit 22 acquires, via an image data input unit (not illustrated) as an example of an acquisition unit, image data transmitted from a PC, a scanner or the like, then performs predetermined image processing on the acquired image data and generates image data decomposed into each color (each color image data). Then, the image processing unit 22 provides the color image data to the laser exposure device 26 in the image forming process unit 20 via an image data transmission unit (not illustrated) as an example of a transmission unit.

Meanwhile, the photoconductor drums 31 are uniformly charged by the respective charging rolls 32. Then, the laser exposure device 26 scans and exposes the photoconductor drums 31 uniformly charged in the respective image forming units 30 with laser light whose lighting operation is controlled on the basis of the image data of each color transmitted from the image processing unit 22. Thereby, the electrostatic latent image of each color is formed on each of the photoconductor drums 31. Then, the formed electrostatic latent image is developed by the developing devices 33. Thereby, the color toner images are formed on the photoconductor drums 31, respectively.

As described above, the laser exposure device 26 and the image forming units 30, along with other components when necessary, function as a toner image forming unit.

The color toner images formed respectively in the image forming units 30 are sequentially primarily transferred onto the intermediate transfer belt 41 by the primary transfer rolls 42. Thereby the superimposed toner images of each color toner image are formed on the intermediate transfer belt 41. At this time, the intermediate transfer belt 41 circularly moves in a direction of an arrow B in FIG. 1 by a drive roll 49, and the predetermined primary transfer bias voltage is applied to each of the primary transfer rolls 42. The superimposed toner images are transported along with the movement of the intermediate transfer belt 41 toward the secondary transfer portion Tr2 where the secondary transfer roll 40 and the drive roll 49 are arranged.

Meanwhile, multiple sheet holding units 71A and 71B, for example, are arranged in the image forming apparatus 1. The sheet P1 held by the sheet holding unit 71A, for example, is taken out by a pickup roll 72 on the basis of an instruction inputted by the user using an operation input unit (not illustrated), for example. The taken out sheets P1 are then transported one by one by pre-registration transport rolls 73 along a transport route R1 as far as the position of registration rolls 74.

The registration rolls 74 supply the sheet P1 to the secondary transfer portion Tr2 at timing when the superimposed toner images on the intermediate transfer belt 41 arrive at the secondary transfer portion Tr2. Then, the superimposed toner images are collectively secondarily transferred onto the sheet P1 by action of a transfer electric field formed between the drive roll 49 and the secondary transfer roll 40 having the predetermined secondary transfer bias voltage applied thereto.

Incidentally, the sheets P are also transported to the secondary transfer portion Tr2 via a transport route R2 for duplex printing used when print is made on both surfaces of the sheets P, or a transport route R3 from a sheet holding unit 75 for manual sheet feeding, in addition to the transport route R1 along which the sheets P1 and P2 held respectively by the sheet holding units 71A and 71B are transported.

Thereafter, the sheet P1 having color toner images electrostatically transferred thereon at the secondary transfer portion Tr2 is peeled from the intermediate transfer belt 41 and transported toward the fixing device 80. In the fixing device 80, the sheet P1 passes through the nip portion Fnip of the fixing device 80, and thereby, the color toner images are fixed onto the sheet P1. Then, the sheet P1 having the fixed image formed thereon is transported to a sheet stacking unit 91 provided at an output unit of the image forming apparatus 1. Meanwhile, the toner (transfer residual toner) attached to the intermediate transfer belt 41 after the secondary transfer is removed by a belt cleaner 45, which is arranged in contact with the intermediate transfer belt 41, for the next image forming cycle.

In this way, the image formation in the image forming apparatus 1 is repeatedly performed for a designated number of sheets.

<Description of Sheet Transporting Mechanism of Image Forming Apparatus>

Next, a description will be given of a transporting mechanism for the sheet P transported from the pre-registration transport rolls 73 and the registration rolls 74 to the fixing device 80 via the secondary transfer portion Tr2 in the image forming apparatus 1 according to the present exemplary embodiment.

Figure 2:
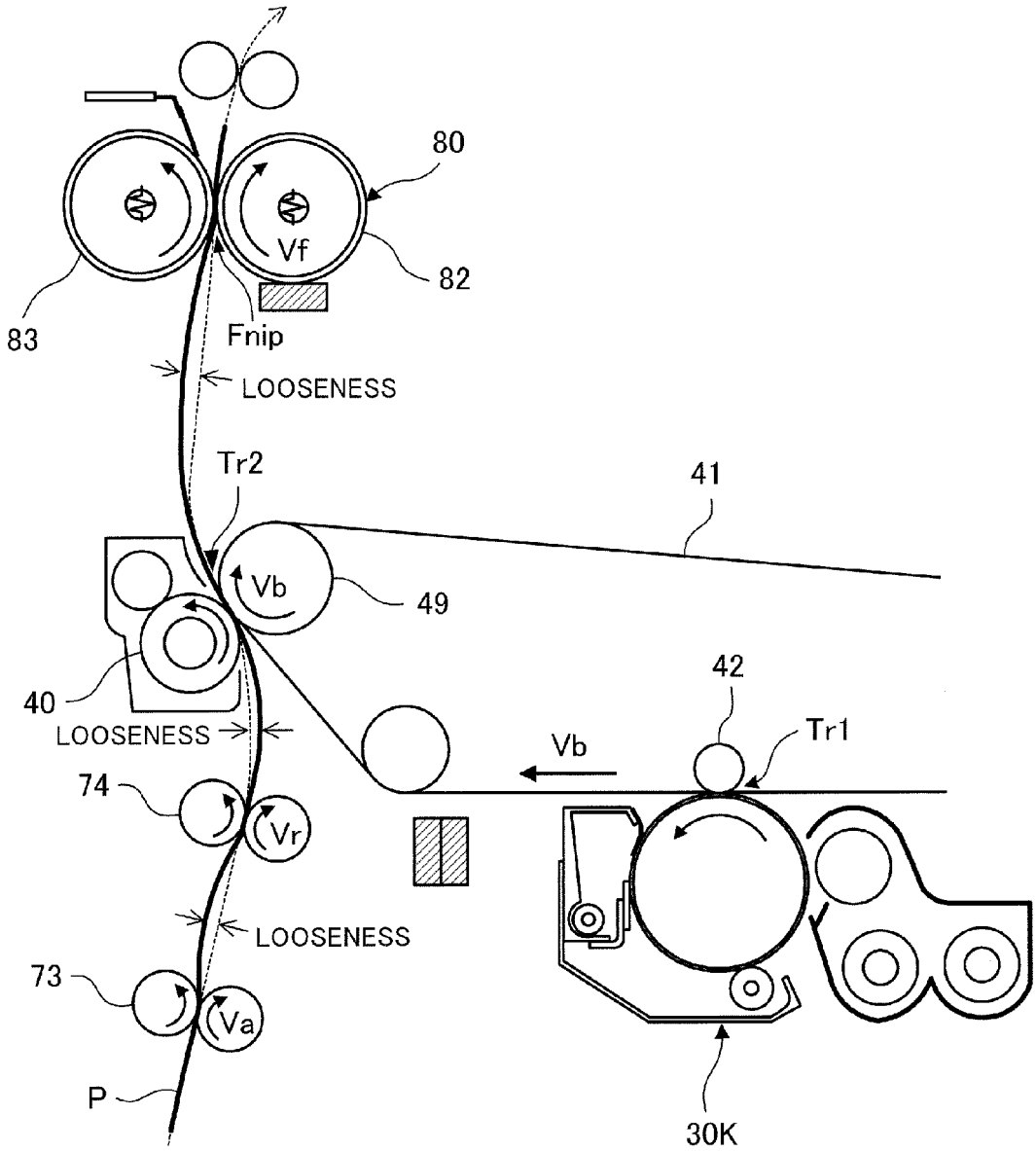
FIG. 2 is a diagram showing the transporting mechanism for the sheet from the pre-registration transport rolls to the fixing device.

FIG. 2 is a diagram showing the transporting mechanism for the sheet P from the pre-registration transport rolls 73 to the fixing device 80. As shown in FIG. 2, the pre-registration transport rolls 73 transport the sheet P toward the registration rolls 74 at a transport velocity Va by use of a drive mechanism (not illustrated). The registration rolls 74 transport the sheet P toward the secondary transfer portion Tr2 at a transport velocity Vr by use of a drive mechanism (not illustrated) at timing when the superimposed toner images are transported to the secondary transfer portion Tr2. Meanwhile, the circumferential velocity of the drive roll 49 that drives the intermediate transfer belt 41 is set at a design value Vb that is previously determined. This drive roll 49 drives the intermediate transfer belt 41 to circularly move at a moving velocity Vb. In addition, in the fixing device 80, the fixing roll 82 and the pressing roll 83 rotate at a circumferential velocity Vf.

In the upstream side of the secondary transfer portion Tr2, the transport velocity Va of the sheet P transported by the pre-registration transport rolls 73, the transport velocity Vr of the sheet P transported by the registration rolls 74 and the moving velocity Vb of the intermediate transfer belt 41 driven by the drive roll 49 are set to satisfy a relation of $Va \geq Vr \geq Vb$.

Specifically, it is ideal that the transport velocity of the sheet P at the secondary transfer portion Tr2 coincides with the moving velocity Vb of the intermediate transfer belt 41 at the secondary transfer portion Tr2 where the superimposed toner images are transferred. This is because, if the transport velocity of the sheet P coincides with the moving velocity Vb of the intermediate transfer belt 41, the superimposed toner images held on the intermediate transfer belt 41 are transferred onto the sheet P by a one-to-one relationship, so that no magnification shift in the transport direction of the sheet P occurs in the superimposed toner images.

However, there exists a dimensional error or an assembly error in manufacturing of components or the like constituting the intermediate transfer belt 41 or the transport mechanism for the sheet P in the actual image forming apparatus 1. In addition, non-uniform rotation of the drive motor or the like exists when the intermediate transfer belt 41 and the transport mechanism are driven in the actual image forming apparatus 1. For this reason, it is difficult to make the transport velocity of the sheet P precisely coincide with the moving velocity Vb of the intermediate transfer belt 41 without any error. Accordingly, the relationship of Va, Vr and Vb is set under the assumption that the transport velocity of the sheet P and the moving velocity Vb of the intermediate transfer belt 41 do not coincide with each other precisely. Specifically, Vr is set not less than Vb, so that looseness of the sheet P occurs in the upstream side of the secondary transfer portion Tr2. Thereby, the influence of the driving from the transport mechanism such as the registration rolls 74 arranged in the upstream side of the secondary transfer portion Tr2 is eased in the secondary transfer portion Tr2, hence making the sheet P move along with the movement of the intermediate transfer belt 41 easily. Likewise, Va is set not less than Vr between the pre-registration transport rolls 73 and the registration rolls 74, so that looseness of the sheet P occurs between the pre-registration transport rolls 73 and the registration rolls 74.

Moreover, in the downstream side of the secondary transfer portion Tr2, for the same reasons as those described above, the moving velocity Vb of the intermediate transfer belt 41 and the circumferential velocity Vf of the fixing device 80 are set so as to satisfy a relation of $Vb \geq Vf$. For this reason, looseness of the sheet P occurs between the secondary transfer portion Tr2 and the fixing device 80. Accordingly, the influence of the driving from the fixing device 80 arranged in the downstream side of the secondary transfer portion Tr2 is eased, hence making the sheet P move along with the movement of the intermediate transfer belt 41 easily.

Because of the reasons described above, in the transport mechanisms configured in the transport path of the sheet P at the secondary transfer portion Tr2 and at the upstream and downstream sides of the secondary transfer portion Tr2, the transport velocities for the sheet P are set to satisfy the relation of $Va \geq Vr \geq Vb \geq Vf$.

As described above, velocity differences resulting from the relation of $Va \geq Vr \geq Vb \geq Vf$ are set to the velocities of the transport mechanisms, respectively. Thus, the sheet P is easily transported along with the movement of the intermediate transfer belt 41 in the secondary transfer portion Tr2. As a result, the amount of shifting of the superimposed toner images transferred onto the sheet P from the state of the superimposed toner images held on the intermediate transfer belt 41 is suppressed to be less. However, the moving velocity Vb of the intermediate transfer belt 41 itself is influenced by the velocity differences set in the transport mechanisms arranged in the secondary transfer portion Tr2 and in the upstream and downstream sides of the secondary transfer portion Tr2.

For example, the sheet P transported from the registration rolls 74 is transported at the transport velocity Vr of the registration rolls 74, which is faster than the moving velocity Vb of the intermediate transfer belt 41. For this reason, when the sheet P passes through the secondary transfer portion Tr2, the intermediate transfer belt 41 receives pushing force (acceleration force) from the sheet P by making contact with the sheet P. Thereby, the intermediate transfer belt 41 is accelerated in a moving direction thereof.

In addition, after the sheet P that has passed through the secondary transfer portion Tr2 enters the nip portion Fnip of the fixing device 80, for example, the transport velocity of the sheet P in the downstream side of the secondary transfer portion Tr2 is decelerated by the fixing device 80 having the circumferential velocity Vf, which is slower than the moving velocity Vb of the intermediate transfer belt 41. For this reason, until the looseness of the sheet P is formed between the secondary transfer portion Tr2 and the fixing device 80, the intermediate transfer belt 41 receives pushing-back force (braking force) by the deceleration of the sheet P. Accordingly, the intermediate transfer belt 41 decelerates.

Furthermore, after the bottom edge of the sheet P passes through the registration rolls 74, for example, the transport force from the registration rolls 74 set at the transport velocity Vr, which is faster than the moving velocity Vb of the intermediate transfer belt 41, no longer exists. For this reason, the intermediate transfer belt 41 receives braking force due to the deceleration of the sheet P, and then decelerates as a result.

The change in the moving velocity of the intermediate transfer belt 41 due to the acceleration and deceleration described above becomes greater proportionally to frictional force between the sheet P and the intermediate transfer belt 41. In particular, when the sheet P having a rough surface or being thick paper increasing the nip pressure of the pressed secondary transfer portion Tr2 is used, the amount of change in the moving velocity of the intermediate transfer belt 41 becomes larger because the pushing force and the braking force received by the intermediate transfer belt 41 from the sheet P becomes larger.

<Description Concerning Change in Moving Velocity of Intermediate Transfer Belt>

Subsequently, a description will be given of the change in the moving velocity of the intermediate transfer belt 41, which occurs because of the velocity differences set among the registration rolls 74, the intermediate transfer belt 41 and the fixing device 80 so as to satisfy Vr≥Vb≥Vf.

Figure 3A:
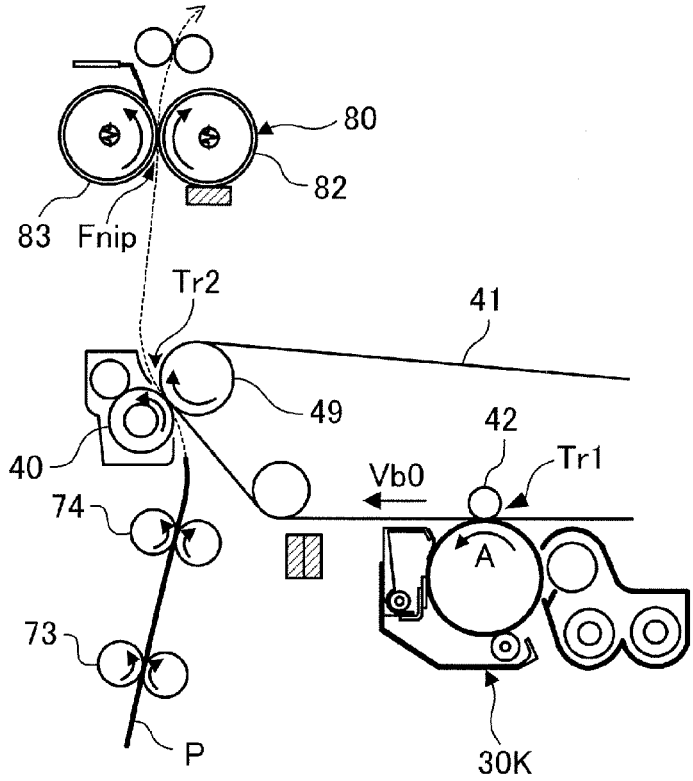
FIG. 3A shows a state before the top edge of the sheet enters the secondary transfer portion.
Figure 3B:
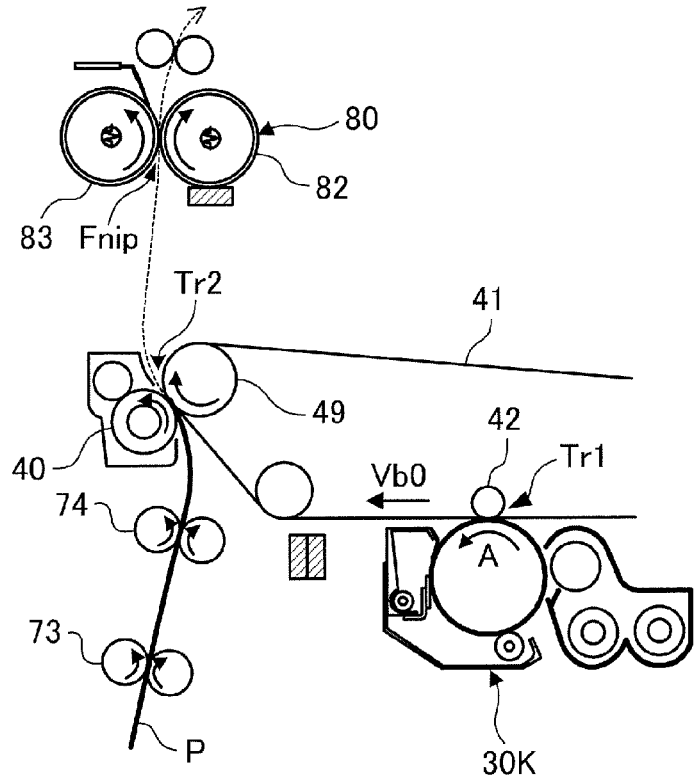
FIG. 3B shows a state when the top edge of the sheet enters the secondary transfer portion.
Figure 4A:
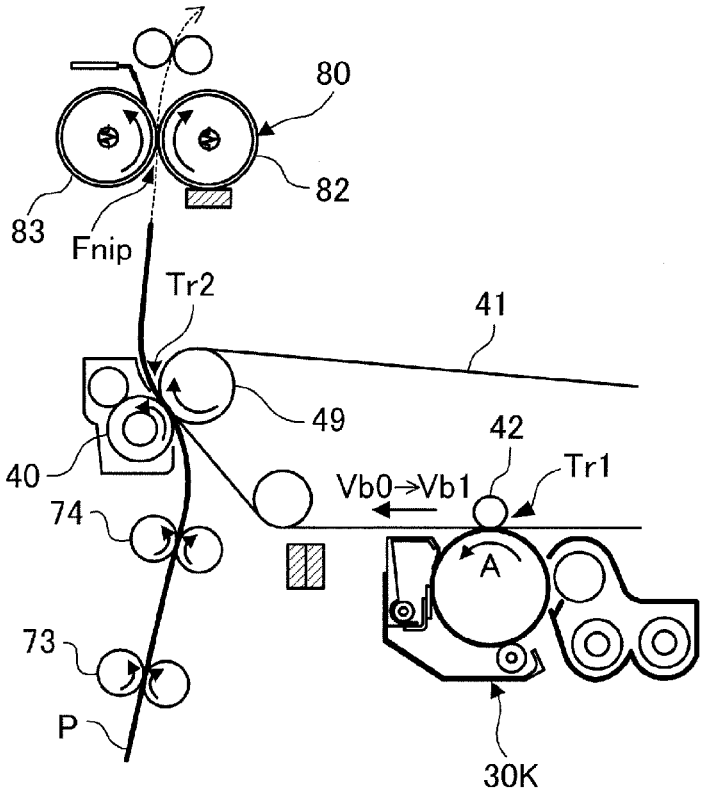
FIG. 4A shows a state when the sheet is passing through the secondary transfer portion and before the top edge of the sheet enters the fixing device.
Figure 4B:
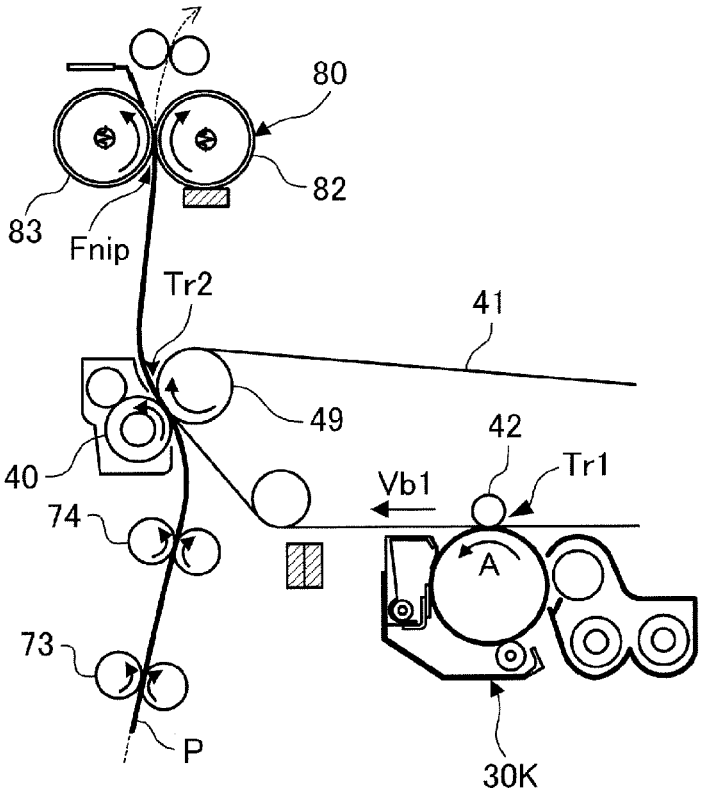
FIG. 4B shows a state when the top edge of the sheet enters the nip portion of the fixing device.
Figure 5A:
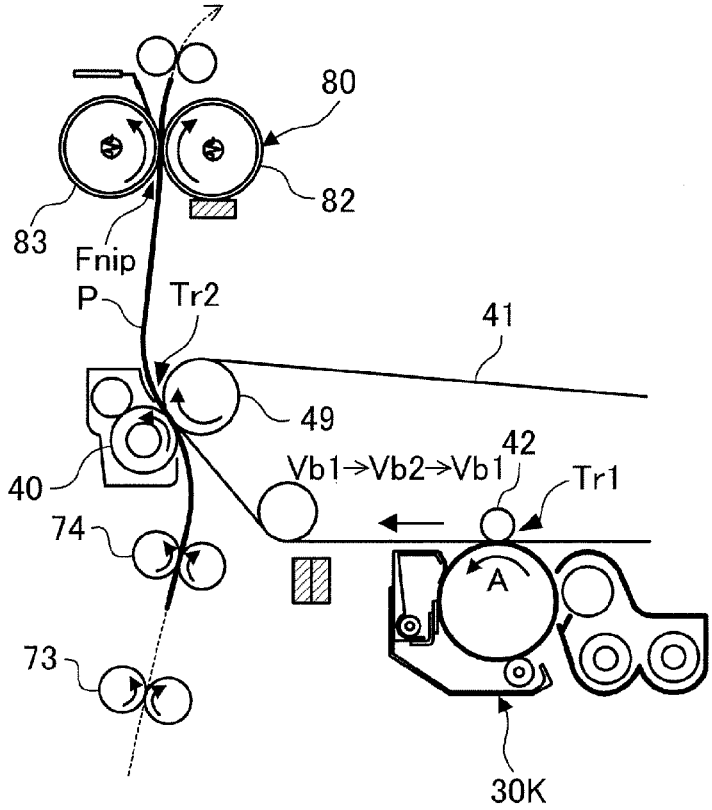
FIG. 5A shows a state when the sheet is passing through both of the registration rolls and the fixing device.
Figure 5B:
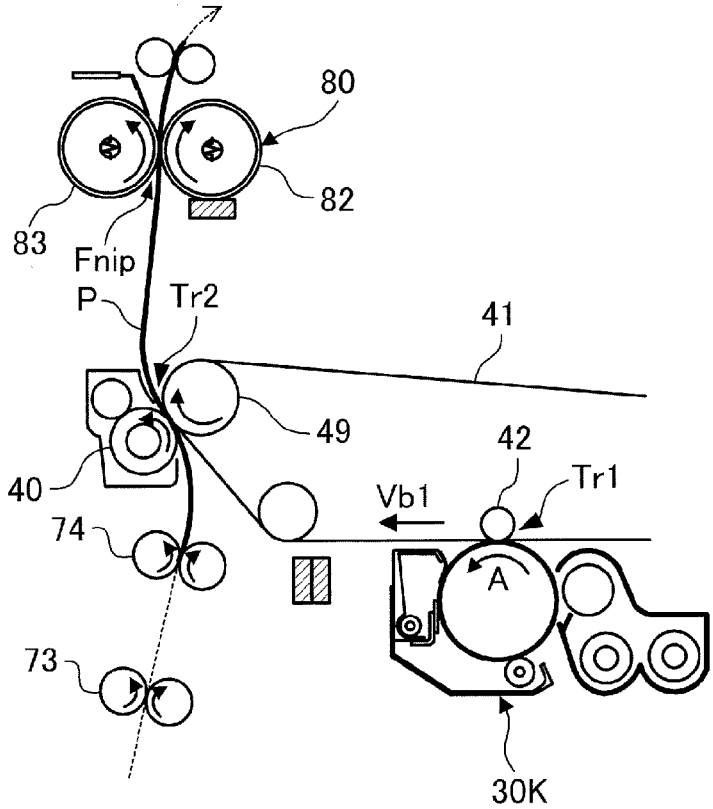
FIG. 5B shows a state when the bottom edge of the sheet passes through the registration rolls.
Figure 6A:
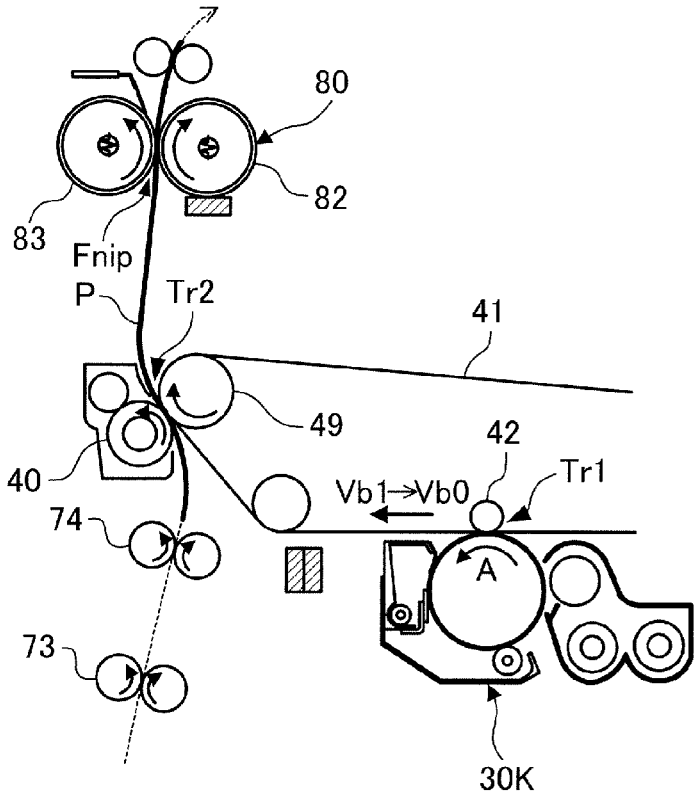
FIG. 6A shows a state after the bottom edge of the sheet passes through the registration rolls.
Figure 6B:
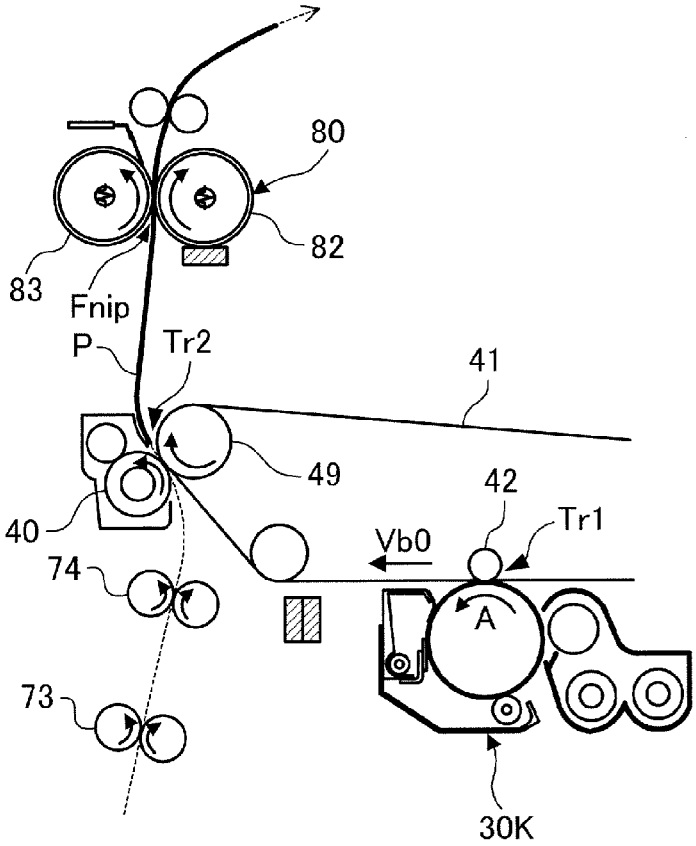
FIG. 6B shows a state after the bottom edge of the sheet passes through the secondary transfer portion.

FIG. 3A shows a state before the top edge of the sheet P enters the secondary transfer portion Tr2. FIG. 3B shows a state when the top edge of the sheet P enters the secondary transfer portion Tr2. FIG. 4A shows a state when the sheet P is passing through the secondary transfer portion Tr2 and before the top edge of the sheet P enters the fixing device 80. FIG. 4B shows a state when the top edge of the sheet P enters the nip portion Fnip of the fixing device 80. FIG. 5A shows a state when the sheet P is passing through both of the registration rolls 74 and the fixing device 80. FIG. 5B shows a state when the bottom edge of the sheet P passes through the registration rolls 74. FIG. 6A shows a state after the bottom edge of the sheet P passes through the registration rolls 74. FIG. 6B shows a state after the bottom edge of the sheet P passes through the secondary transfer portion Tr2.

To begin with, in the state, shown in FIG. 3A, before the top edge of the sheet P enters the secondary transfer portion Tr2, the intermediate transfer belt 41 receives no force from the sheet P at all. For this reason, the intermediate transfer belt 41 moves at the moving velocity Vb0 of the design value.

Next, when the top edge of the sheet P enters the secondary transfer portion Tr2 as shown in FIG. 3B, the intermediate transfer belt 41 starts to receive pushing force from the sheet P by making contact with the sheet P, because the transport velocity of the sheet P is the transport velocity Vr (≥Vb0) set for the registration rolls 74. As a result, the moving velocity Vb of the intermediate transfer belt 41 starts to accelerate from the design value Vb0.

In the state, shown in FIG. 4A, when the sheet P is passing through the secondary transfer portion Tr2 and before the top edge of the sheet P enters the fixing device 80, the moving velocity Vb of the intermediate transfer belt 41 gradually accelerates from the design value Vb0 to the moving velocity Vb1 due to the pushing force from the sheet P transported at the transport velocity Vr of the registration rolls 74.

Thereafter, when the top edge of the sheet P enters the nip portion Fnip of the fixing device 80 as shown in FIG. 4B, the transport velocity of the sheet P in the downstream side of the secondary transfer portion Tr2 decelerates due to the circumferential velocity Vf (≤Vb0) set to the fixing device 80. For this reason, the intermediate transfer belt 41 starts to receive the braking force from the sheet P. As a result, the moving velocity Vb of the intermediate transfer belt 41 starts to decelerate from the moving velocity Vb1.

Then, in the state, shown in FIG. 5A, when the sheet P is passing through both of the registration rolls 74 and the fixing device 80, the intermediate transfer belt 41 decelerates due to the braking force from the sheet P until the looseness of the sheet P occurs between the secondary transfer portion Tr2 and the fixing device 80. As a result, the moving velocity Vb of the intermediate transfer belt 41 becomes the moving velocity Vb2 (≤Vb1) before the looseness of the sheet P occurs between the secondary transfer portion Tr2 and the fixing device 80. Thereafter, the braking force received by the intermediate transfer belt 41 from the sheet P becomes smaller after the looseness of the sheet P occurs between the secondary transfer portion Tr2 and the fixing device 80. For this reason, the intermediate transfer belt 41 gradually accelerates again from the moving velocity Vb2 due to the pushing force from the sheet P transported at the transport velocity Vr of the registration rolls 74. Then, the moving velocity Vb of the intermediate transfer belt 41 becomes the moving velocity Vb1.

Thereafter, when the bottom edge of the sheet P passes through the registration rolls 74 as shown in FIG. 5B, the intermediate transfer belt 41 no longer receives the pushing force from the sheet P transported at the transport velocity Vr of the registration rolls 74. As a result, the intermediate transfer belt 41 receives the braking force from the sheet P, and the moving velocity Vb of the intermediate transfer belt 41 starts to decelerate from the moving velocity Vb1.

Subsequently, after the bottom edge of the sheet P passes through the registration rolls 74 as shown in FIG. 6A, the intermediate transfer belt 41 gradually decelerates from the moving velocity Vb1, and the moving velocity Vb of the intermediate transfer belt 41 returns to the design value Vb0.

Then, the bottom edge of the sheet P passes through the secondary transfer portion Tr2 as shown in FIG. 6B in the state where the moving velocity Vb of the intermediate transfer belt 41 returns to the design value Vb0.

Figure 7:
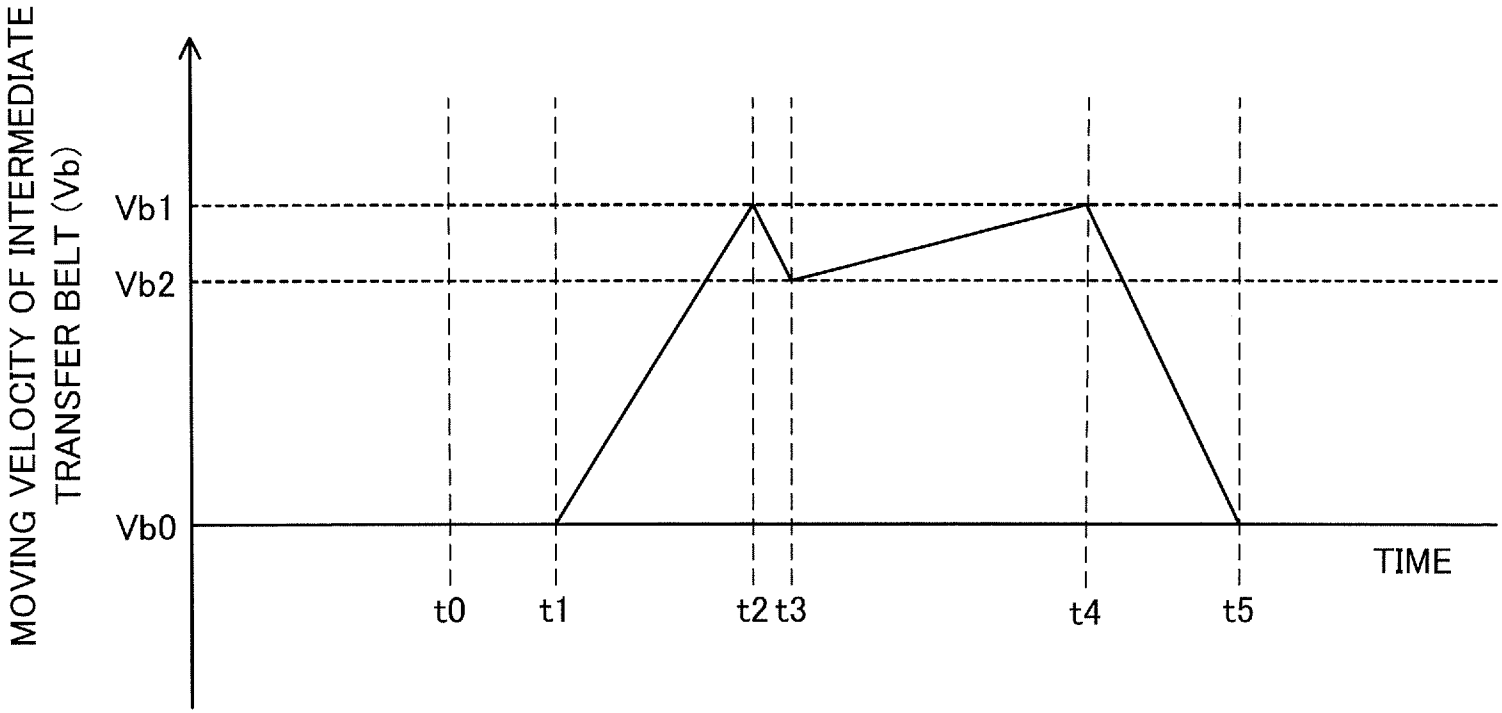
FIG. 7 is a diagram showing the change in the moving velocity of the intermediate transfer belt.

Next, FIG. 7 is a diagram showing the change in the moving velocity Vb of the intermediate transfer belt 41. As shown in FIG. 7, transportation of the sheet P from the registration rolls 74 starts (t0), the moving velocity Vb of the intermediate transfer belt 41 remains at the design value Vb0 until a time point t1 when the top edge of the sheet P enters the secondary transfer portion Tr2 (FIGS. 3A and 3B). Subsequently, until a time point t2 when the top edge of the sheet P enters the fixing device 80 (FIGS. 4A and 4B), the moving velocity Vb of the intermediate transfer belt 41 gradually accelerates from the design value Vb0 to the moving velocity Vb1 due to the pushing force from the sheet P transported at the transport velocity Vr of the registration rolls 74.

Next, after the time point t2 when the top edge of the sheet P enters the fixing device 80 (FIG. 4B), the intermediate transfer belt 41 decelerates due to the braking force from the sheet P, and the moving velocity Vb of the intermediate transfer belt 41 becomes the moving velocity Vb2 (≤Vb1) until a time point t3 when the looseness of the sheet P occurs between the secondary transfer portion Tr2 and the fixing device 80 (FIG. 5A). After the time point t3 when the looseness of the sheet P occurs between the secondary transfer portion Tr2 and the fixing device 80 (FIG. 5A), the braking force received by the intermediate transfer belt 41 from the sheet P becomes smaller. As a result, the intermediate transfer belt 41 gradually accelerates again from the moving velocity Vb2.

Then, by a time point t4 when the bottom edge of the sheet P passes through the registration rolls 74 (FIG. 5B), the moving velocity Vb of the intermediate transfer belt 41 becomes the moving velocity Vb1 again.

Subsequently, after the time point t4 when the bottom edge of the sheet P passes through the registration rolls 74 (FIG. 6A), the intermediate transfer belt 41 receives the braking force from the sheet P because the intermediate transfer belt 41 no longer receives the pushing force from the sheet P transported at the transport velocity Vr of the registration rolls 74. As a result, the intermediate transfer belt 41 gradually decelerates from the moving velocity Vb1, and the moving velocity Vb of the intermediate transfer belt 41 returns to the design value Vb0 at a time point t5, which is after the time point t4.

Then, after the time point t5 when the moving velocity Vb of the intermediate transfer belt 41 returns to the design value Vb0, the bottom edge of the sheet P passes through the secondary transfer portion Tr2 (FIG. 6B).

As described above, the moving velocity Vb of the intermediate transfer belt 41 changes as shown in FIG. 7, for example. For this reason, when the color toner images of Y, M, C and K formed on the image forming units 30Y, 30M, 30C and 30K, respectively, are primarily transferred onto the intermediate transfer belt 41, primary transfer shifting of the images corresponding to the amounts of change in the moving velocity Vb of the intermediate transfer belt 41 during a period from the time point t1 when the top edge of the sheet P enters the secondary transfer portion Tr2 to the time point t5 when the moving velocity Vb of the intermediate transfer belt 41 returns to the design value Vb0.

Meanwhile, since the image forming units 30 are arranged at different positions along the intermediate transfer belt 41, time lags exist among time points at which the color toner images of Y, M, C and K are formed respectively. For example, suppose that the image forming units 30 are arranged apart from one another with an equal interval D. In this case, each of the image forming units 30 forms the color toner image for the same image area with a time lag of D/Vb, and then primarily transfers the image. Specifically, if the image forming unit 30K is considered as a basis, the image forming unit 30Y primarily transfers the Y color toner image the time 3D/Vb before the image forming unit 30K, for the same image area. The image forming unit 30M primarily transfers the M color toner image the time 2D/Vb before the image forming unit 30K. The image forming unit 30C primarily transfers the C color toner image the time D/Vb before the image forming unit 30K. Accordingly, during the period from the time point t1 when the top edge of the sheet P enters the secondary transfer portion Tr2 to the time point t5 when the moving velocity Vb of the intermediate transfer belt 41 returns to the design value Vb0, each of the image forming units 30 performs image forming for a different image area, and then primarily transfers the toner image on the intermediate transfer belt 41. For this reason, the amounts of the primary transfer shifting of the respective color toner images in the same image area, corresponding to the amount of change in the moving velocity Vb of the intermediate transfer belt 41 are different from each other among the color toner images. As a result, color shifting occurs in the image.

Figure 8:
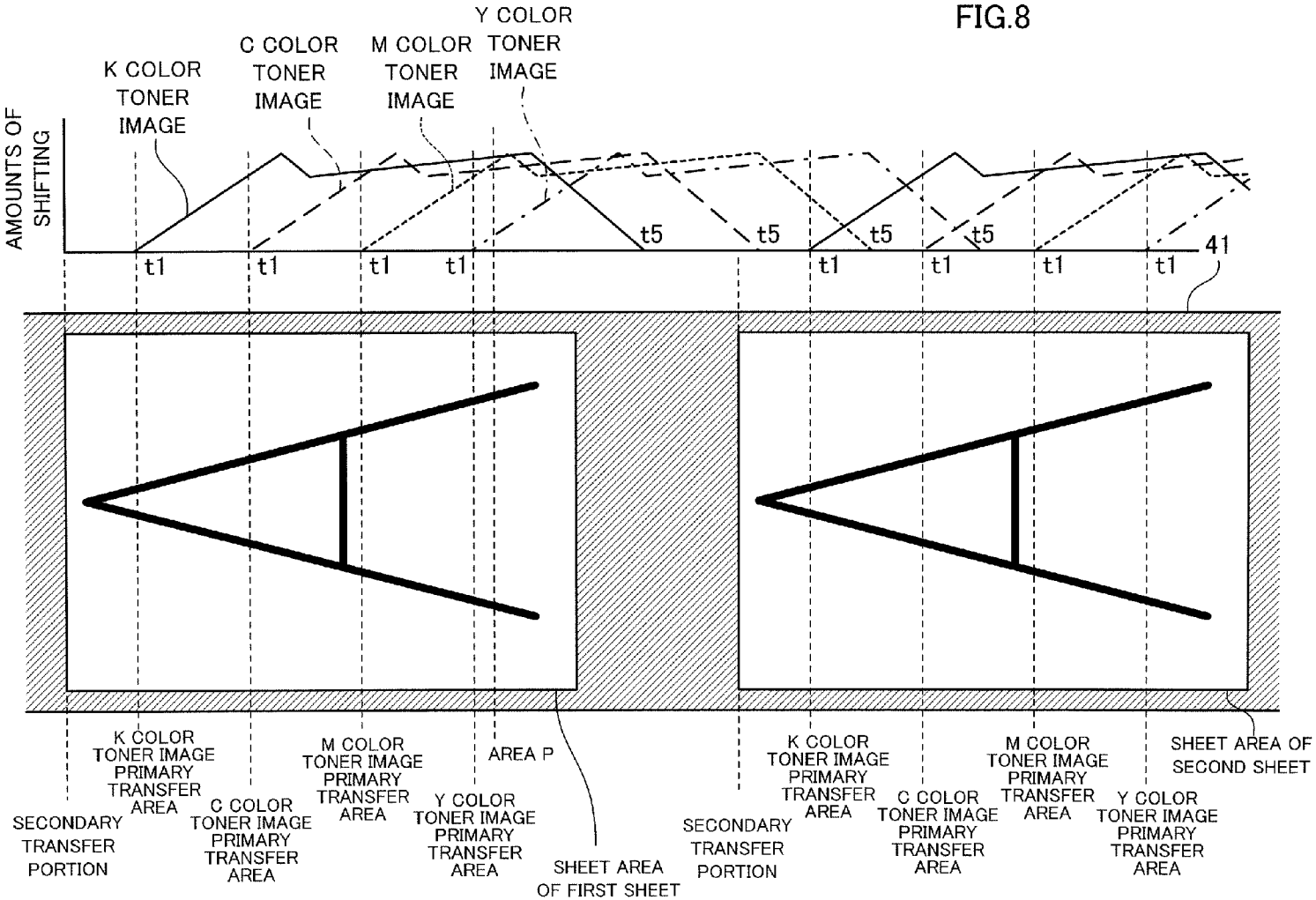
FIG. 8 is a diagram for explaining the color shifting that occurs in the image.

FIG. 8 is a diagram for explaining the color shifting that occurs in the image. FIG. 8 shows: a sheet area of the first sheet and a sheet area of the second sheet on the intermediate transfer belt 41; areas where the image forming units 30 primarily transfer the respective color toner images on the intermediate transfer belt 41 (primary transfer areas of the color toner images); and areas where secondary transfer is performed (secondary transfer portion Tr2). As shown in FIG. 7 described above, the change in the moving velocity Vb of the intermediate transfer belt 41 starts from the time point t1 when the top edge of the sheet area of the first sheet enters the secondary transfer portion Tr2. Then, after the time point t1, for the image forming unit 30K, the primary transfer shifting corresponding to the amount of change in the moving velocity Vb of the intermediate transfer belt 41 occurs in an area on further downstream side of the intermediate transfer belt 41 than the primary transfer area of the K color toner image. Likewise, for the respective image forming units 30C, 30M, and 30Y, the primary transfer shifting corresponding to the amount of change in the moving velocity Vb of the intermediate transfer belt 41 occurs in an area further downstream side of the intermediate transfer belt 41 than each of the primary transfer areas of the C, M and Y color toner images. For this reason, as shown in FIG. 8, the primary transfer shifting corresponding to the pattern of the change in the moving velocity Vb of the intermediate transfer belt 41 occurs in each color toner image in accordance with the shifting in the mutual arrangement positions of the image forming units 30. As a result, the amounts of primary transfer shifting of the respective color toner images are different from each other on the same image area, hence causing the color shifting in the image. The color shifting occurs in the sheet area of the second sheet and thereafter in the same manner.

In other words, such color shifting in the image occurs because of the following reason. The color toner images formed in the same size (length) in the slow scan direction on the photoconductor drums 31 of the image forming units 30, respectively, are expanded or contracted on the intermediate transfer belt 41 at the time of the primary transfer because of the change in the moving velocity Vb of the intermediate transfer belt 41. As a result, the sizes of the color toner images on the intermediate transfer belt 41 in the slow scan direction do not coincide with one another (the sizes are no longer the same in the slow scan direction).

<Description of Mechanism Causing Color Shifting on Image>

A description will be further given of a mechanism causing the color shifting in the image.

Figure 9:
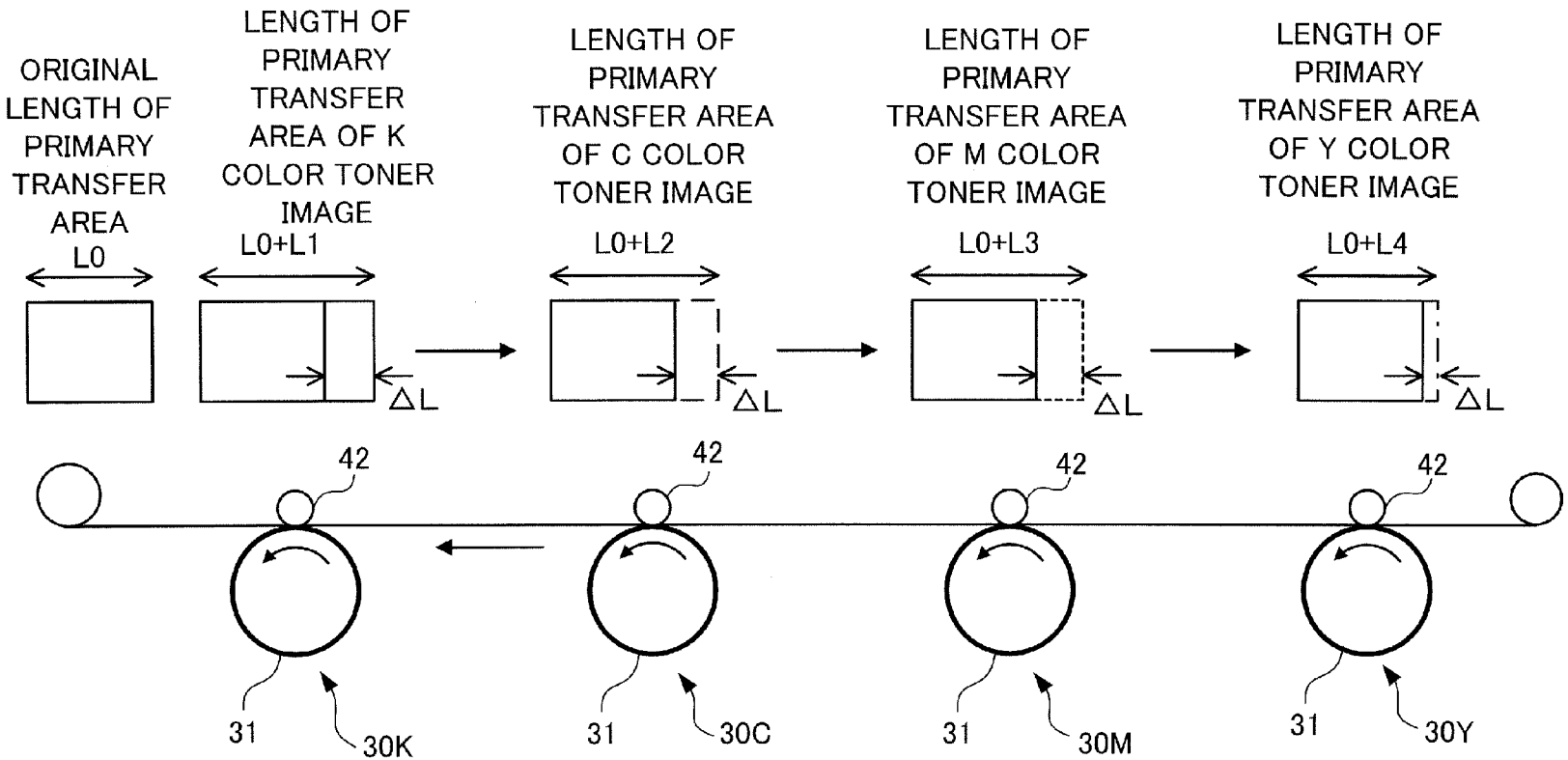
FIG. 9 is a diagram conceptually showing that the sizes in the slow scan direction in the primary transfer area for the same image area are different among the respective color toner images.

FIG. 9 is a diagram conceptually showing that the sizes in the slow scan direction in the primary transfer area for the same image area are different among the respective color toner images because of the change in the moving velocity Vb of the intermediate transfer belt 41. In a case where the intermediate transfer belt 41 in the secondary transfer portion Tr2 moves at the design value Vb0 (design velocity) without being influenced by the sheet P, the primary transfer area on the intermediate transfer belt 41 which is assigned for each of the color toner images forming the same image area is an area having the design size (length) of L0 (original length of the primary transfer area) in the slow scan direction for each of the color toner images, as shown at the left side of FIG. 9. Accordingly, each of the color toner images formed for the area having the size (length) L0 in the slow scan direction on the photoconductor drum 31 of the image forming unit 30 is primarily transferred on the area having the size L0 in the slow scan direction, that is, the same size on the intermediate transfer belt 41. Thus, the color shifting occurring in the image is minor in this case.

However, as described using FIG. 8, since the amounts of change in the moving velocity Vb of the intermediate transfer belt 41 are different among the primary transfer areas for the respective color toner images, the lengths of the primary transfer areas (lengths of the primary transfer areas of the respective color toner images) on the intermediate transfer belt 41, assigned for the respective color toner images forming the same image area are different in the slow scan direction. For example, the size of the primary transfer area assigned for the K color toner image (the length of the primary transfer area of the K color toner image) forming the same image area is length L0+L1 in the slow scan direction. Likewise, the length of the primary transfer area of the C color toner image is length L0+L2 in the slow scan direction. The length of the primary transfer area of the M color toner image is length L0+L3 in the slow scan direction. The length of the primary transfer area of the Y color toner image is length L0+L4 in the slow scan direction. Here, L1, L2, L3 and L4 each is the amount of expansion (ΔL) of the primary transfer area due to the change in the moving velocity Vb of the intermediate transfer belt 41. In this present exemplary embodiment, since the intermediate transfer belt 41 moves faster than the design value Vb0, each of L1, L2, L3 and L4 is ≥0. Note that, in another exemplary embodiment in which the intermediate transfer belt 41 moves slower than the design value Vb0, each of L1, L2, L3 and L4 may become <0.

For this reason, the color toner images formed on the photoconductor drums 31 of the image forming units 30 are expanded in the slow scan direction by (L0+L1)/L0 times, (L0+L2)/L0 times, (L0+L3)/L0 times and (L0+L4)/L0 times, respectively, when the color toner images are primarily transferred onto the intermediate transfer belt 41. Thus, the color shifting occurs in the image because the ratios of expansion of the respective color toner images at the time of primary transfer are different.

Figure 10:
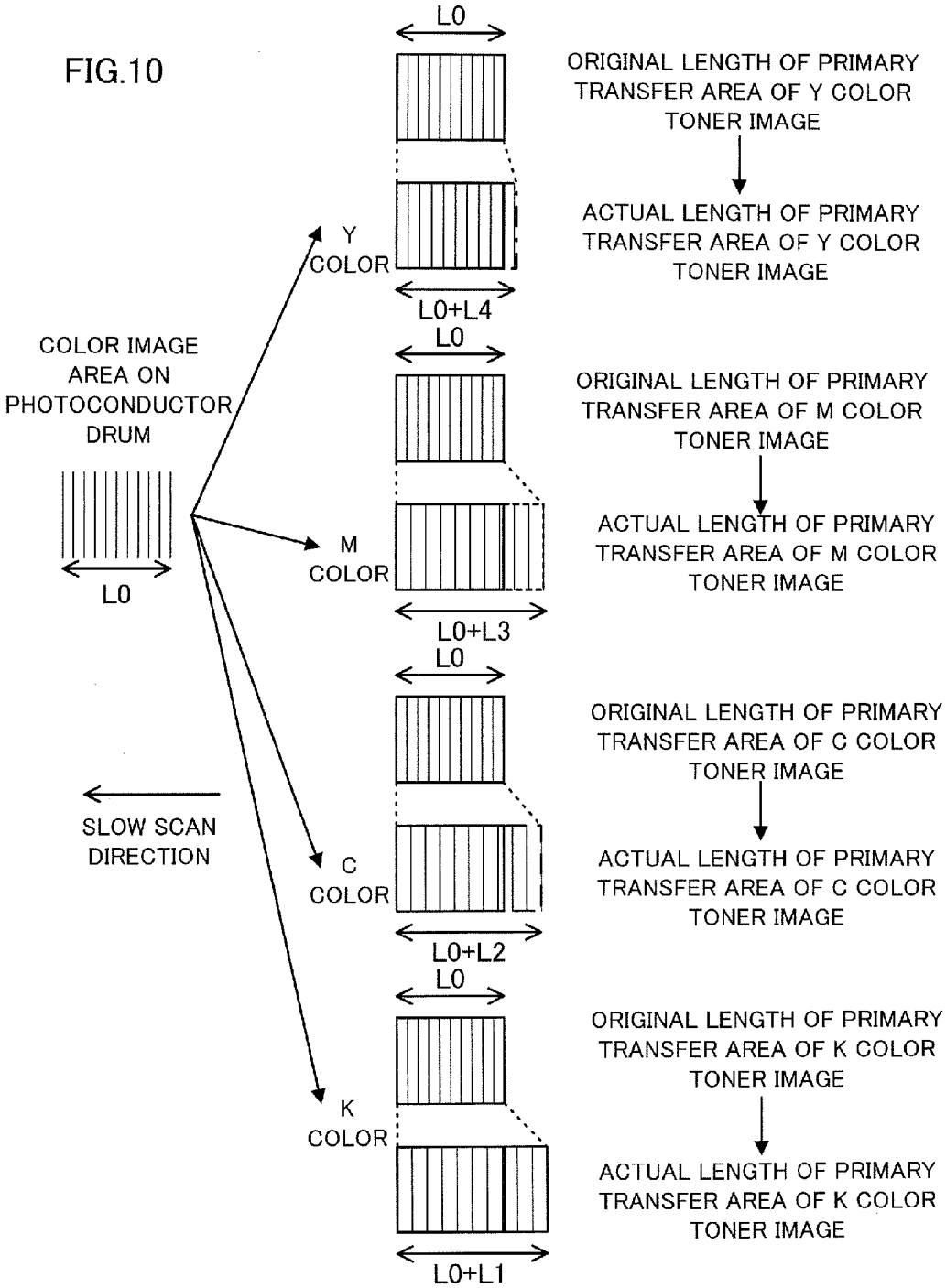
FIG. 10 is a diagram showing comparison of the lengths of the primary transfer areas of the color toner images in the slow scan direction when the color toner images forming the same image area are primarily transferred onto the intermediate transfer belt.

Here, FIG. 10 is a diagram showing comparison of the lengths of the primary transfer areas of the color toner images in the slow scan direction when the color toner images forming the same image area are primarily transferred onto the intermediate transfer belt 41. Note that, FIG. 10 exemplifies the lengths of the primary transfer areas assigned for the respective color toner images in the area P of FIG. 8. As described using FIG. 9, since the moving velocity Vb of the intermediate transfer belt 41 changes, the sizes of the primary transfer areas assigned for the color toner images forming the same image area are different in the slow scan direction. For this reason, the color toner images formed in the same size (length) L0 in the slow scan direction on the photoconductor drums 31 of the respective image forming units 30 are no longer in the same size (length) in the primary transfer areas of the respective color toner images on the intermediate transfer belt 41. Specifically, as shown in FIG. 10, the sizes of the color toner images originally formed in the size L0 in the slow scan direction on the respective photoconductor drums 31 become the sizes L0+L1 for the K color toner image, L0+L2 for the C color toner image, L0+L3 for the M color toner image, and L0+L4 for the Y color toner image in the slow scan direction, respectively, on the intermediate transfer belt 41.

Note that, in FIG. 10, the length of the primary transfer area of each of the color toner images in the case where the moving velocity Vb of the intermediate transfer belt 41 is the design value Vb0 is referred to as an "original length of the primary transfer area." Moreover, the size of each of the primary transfer areas of the color toner images in the slow scan direction in the case where the moving velocity Vb of the intermediate transfer belt 41 changes is referred to as an "actual length of the primary transfer area."

Specifically, since the amount of change in the moving velocity Vb of the intermediate transfer belt 41 for the Y color toner image in the area P in FIG. 8, which is exemplified in FIG. 10, is small, a difference (L4) between the "original length of the primary transfer area" and the "actual length of the primary transfer area" is small. On the contrary to this, since the amounts of change in the moving velocity Vb of the intermediate transfer belt 41 are relatively large for the C, M and K color toner images, respectively, in the area P in FIG. 8, which is exemplified in FIG. 10, differences (L1, L2 and L3) between the "original length of the primary transfer areas" and the "actual length of the primary transfer areas" are large. For this reason, in the area P in FIG. 8, a large amount of shifting between the Y color toner image and the C, M and K color toner images occurs in the image area in the slow scan direction on the intermediate transfer belt 41, hence, causing color shifting in the image.

<Description of Image Processing Performed by Image Processor>

In this respect, in the image forming apparatus 1 of the present exemplary embodiment, in each of the color electrostatic latent images (color toner images) formed on the photoconductor drums 31 of the image forming units 30, pixel rows, a number of which corresponds to the amount of change in the moving velocity Vb of the intermediate transfer belt 41 shown in FIG. 7, for example, are added (interpolated) or reduced (thinned out) at a position, in the slow scan direction, of each of the color electrostatic latent images. This processing is performed for the purpose of causing the sizes (lengths of the primary transfer areas) in the slow scan direction of the color toner images forming the same image area on the intermediate transfer belt 41 to coincide with or approximate each other. Here, the "pixel row" refers to a row of pixels in the fast scan direction, and each of the color electrostatic latent images is formed of rows of pixels arranged in the slow scan direction.

Specifically, in the present exemplary embodiment, as shown in FIG. 7, for example, the moving velocity Vb of the intermediate transfer belt 41 becomes faster than the design value Vb0 (design velocity) when the intermediate transfer belt 41 receives the pushing force from the sheet P entering the secondary transfer portion Tr2. For this reason, for each of the color electrostatic latent images formed on the photoconductor drums 31 of the image forming units 30, the image processing unit 22 as an example of the image processing unit (image processor) of the present exemplary embodiment performs thinning-out processing by which the pixel rows in the slow scan direction are reduced (thinned out), for example, by the number of pixel rows (the number of rows) corresponding to the amount of change in the moving velocity Vb of the intermediate transfer belt 41 shown in FIG. 7. For example, when the amount of change in the moving velocity Vb of the intermediate transfer belt 41 is large, the image processing unit 22 performs, for the electrostatic latent image, image processing in which the number of rows to be thinned out in the slow scan direction is set to be larger proportionally to the amount of change in the moving velocity Vb. On the other hand, when the amount of change in the moving velocity Vb of the intermediate transfer belt 41 is small, the image processing unit 22 performs, for the electrostatic latent image, image processing in which the number of rows to be thinned out in the slow scan direction is set to be smaller proportionally to the amount of change in the moving velocity Vb.

Thereby, for a toner image to be expanded in the primary transfer area, an electrostatic latent image contracted in the slow scan direction is formed on the photoconductor drum 31 by the thinning-out processing, performed by the image processing unit 22, of the number of pixel rows (the number of rows) in the slow scan direction. Accordingly, since the toner image on the photoconductor drum 31 formed by being contracted in the slow scan direction is expanded in the slow scan direction on the intermediate transfer belt 41 in the primary transfer area, the toner image is primarily transferred with the original length of the primary transfer area under the state where the intermediate transfer belt 41 moves at the design value Vb0 (design velocity). At this time, the number of pixel rows to be thinned out in the slow scan direction from the electrostatic latent image is set in accordance with the amount of change in the moving velocity Vb of the intermediate transfer belt 41 in each of the primary transfer areas of the color toner images in order for the electrostatic latent image to be primarily transferred with the original length of the primary transfer area. Furthermore, since the amounts of change in the moving velocity Vb of the intermediate transfer belt 41 are different depending on the primary transfer areas of the color toner images even for the same image area, the numbers of pixel rows to be thinned out are set separately for the respective color toner images. Thereby, when the color toner images formed in the image forming units 30 are primarily transferred onto the intermediate transfer belt 41, the sizes of the color toner images in the slow scan direction on the same image area on the intermediate transfer belt 41 coincide with or approximate each other in response to the change in the moving velocity Vb of the intermediate transfer belt 41. Thereby, the amount of color shifting occurring in the image is reduced.

<Description of Amount of Thinning-Out Set for Each Color Toner Image>

Figure 11:
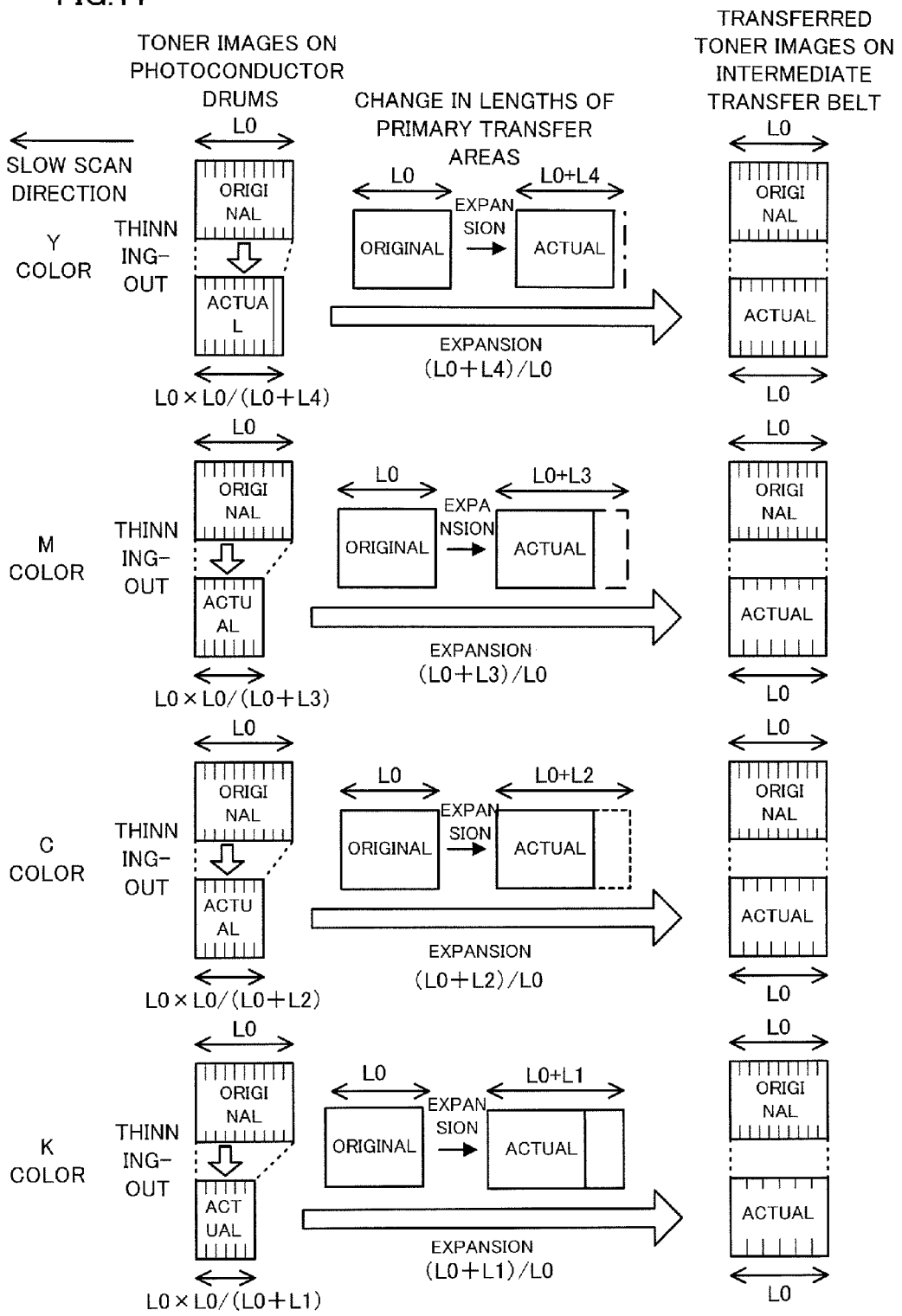
FIG. 11 is a diagram for explaining the amount of thinning-out in the slow scan direction that is set for each of the color toner images in the area P so as to reduce the amount of color shifting in the area P.

A description will be given of the amount of thinning-out in the slow scan direction that is set for each of the color toner images in the area P in FIG. 8 as exemplified in FIG. 10. FIG. 11 is a diagram for explaining the amount of thinning-out in the slow scan direction that is set for each of the color toner images in the area P so as to reduce the amount of color shifting in the area P.

As described above, when the color toner images are primarily transferred onto the intermediate transfer belt 41, the K, C, M and Y color toner images are expanded in the slow scan direction by (L0+L1)/L0 times, (L0+L2)/L0 times, (L0+L3)/L0 times and (L0+L4)/L0 times, respectively. Thus, when the K color toner image is formed on the photoconductor drum 31, the image processing unit 22 sets the number of pixel rows of the electrostatic latent image in the slow scan direction in the area P in FIG. 8 to be L0/(L0+L1) times of the original number of pixel rows in the slow scan direction in the area P, as shown in FIG. 11. Specifically, the image processing unit 22 performs the processing to thin out the number of pixel rows of "the pixel density p in the slow scan direction×(L0−L0/(L0+L1))" in the K color electrostatic latent image.

As a result, the K color toner image having the size of L0×L0/(L0+L1) in the slow scan direction is formed on the photoconductor drum 31. When this K color toner image is primarily transferred onto the intermediate transfer belt 41, the K color toner image is expanded by (L0+L1)/L0 times. Specifically, the K color toner image having the size of L0×L0/(L0+L1)×(L0+L1)/L0=L0 in the slow scan direction is formed on the intermediate transfer belt 41.

Likewise, when the C, M and Y color toner images are formed on the respective photoconductor drums 31, the image processing unit 22 sets the numbers of pixel rows of the electrostatic latent images in the slow scan direction in the area P in FIG. 8 to be L0/(L0+L2) times, L0/(L0+L3) times and L0/(L0+L4) times of the original numbers of pixel rows in the slow scan direction in the area P, respectively. Specifically, the image processing unit 22 performs the processing to thin out the number of pixel rows of "the pixel density p in the slow scan direction×(L0−L0/(L0+L2))" in the C color electrostatic latent image, the number of pixel rows of "the pixel density p in the slow scan direction×(L0−L0/(L0+L3))" in the M color electrostatic latent image, and the number of pixel rows of "the pixel density p in the slow scan direction×(L0−L0/(L0+L4))" in the Y color electrostatic latent image. Thereby, the C, M and Y color toner images each having the size of L0 in the slow scan direction are formed in the area P on the intermediate transfer belt 41.

As a result, the color toner images each formed on the photoconductor drum 31 originally with the size of L0 in the slow scan direction are primarily transferred as the color toner images having the size of L0 in the slow scan direction in the area P on the intermediate transfer belt 41. Thus, the sizes of the color toner images in slow scan direction on the same image area on the intermediate transfer belt 41 coincide with or approximate each other, thereby, reducing the amount of color shifting.

As described above, when the change in the moving velocity Vb of the intermediate transfer belt 41 occurs, for the slow scanning direction, the image processing unit 22 of the present exemplary embodiment performs the processing to thin out the number of pixel rows in the slow scanning direction according to the amount of change in the moving velocity Vb of the intermediate transfer belt 41. As a result, the sizes of the color toner images in the slow scan direction on the same image area (for example, the area P in FIG. 8) on the intermediate transfer belt 41 coincide with or approximate each other, thereby, reducing the amount of color shifting.

In this case, the number of pixel rows to be thinned out from each of the color toner images is set in accordance with the amount of expansion (ΔL) of the primary transfer area assigned for the color toner image on the intermediate transfer belt 41. For example, in the area P in FIG. 8, the numbers of pixel rows to be thinned out from the color toner images (electrostatic latent images) in the area P are set in accordance with L1, L2, L3 and L4, respectively.

Note that, when the amount of change in the moving velocity Vb of the intermediate transfer belt 41 is negative, that is, when the moving velocity Vb of the intermediate transfer belt 41 becomes slower than the design value Vb0, the image processing unit 22 performs image processing to interpolate pixel rows in the slow scan direction.

Next, a description will be given of the amount of thinning-out that is set in accordance with a position in the slow scan direction in each of the color toner images.

As described above, the image processing unit 22 of the present exemplary embodiment sets the amount of thinning-out for each of the color toner images in the area P, in accordance with the amounts of expansion (L1, L2, L3 and L4) of the primary transfer areas, in the area P in FIG. 8, for example. However, the amounts of expansion in the primary transfer areas have different profiles (correspondences between positions in the slow scan direction in the respective color toner images and the amounts of expansion in the primary transfer areas) depending on positions in the slow scan direction in the respective color toner images. For this reason, the amounts of expansion of the primary transfer areas (L1, L2, L3 and L4 in the area P in FIG. 8, for example) are different among the respective color toner images depending on the positions in the slow scan direction in the respective color toner images. Furthermore, the amounts of expansion of the primary transfer areas differ depending on the type of the sheet P being used, and also, humidity and temperature inside the image forming apparatus 1.

In this respect, in the present exemplary embodiment, the profiles (see FIG. 7 for example) of the amounts of expansion of the primary transfer areas at the positions in the slow scan direction in the color toner images are previously measured for each type of the sheet P (type of paper), and also, each humidity and temperature inside the image forming apparatus 1. Moreover, the amounts of thinning-out to be set in accordance with the positions in the slow scan direction in the color toner images are previously calculated for the respective color toner images on the basis of the measured profiles. Then, the calculated amounts of thinning-out are stored in a memory as an example of a storage unit (non-volatile memory 104 shown in FIG. 20 described later) in the image processing unit 22 of the present exemplary embodiment. Thereby, when performing image processing for the color image data, the image processing unit 22 performs the thinning-out processing by the amounts of thinning-out stored in the memory for the pixel rows of the color electrostatic latent images in the slow scan direction.

Figure 12:
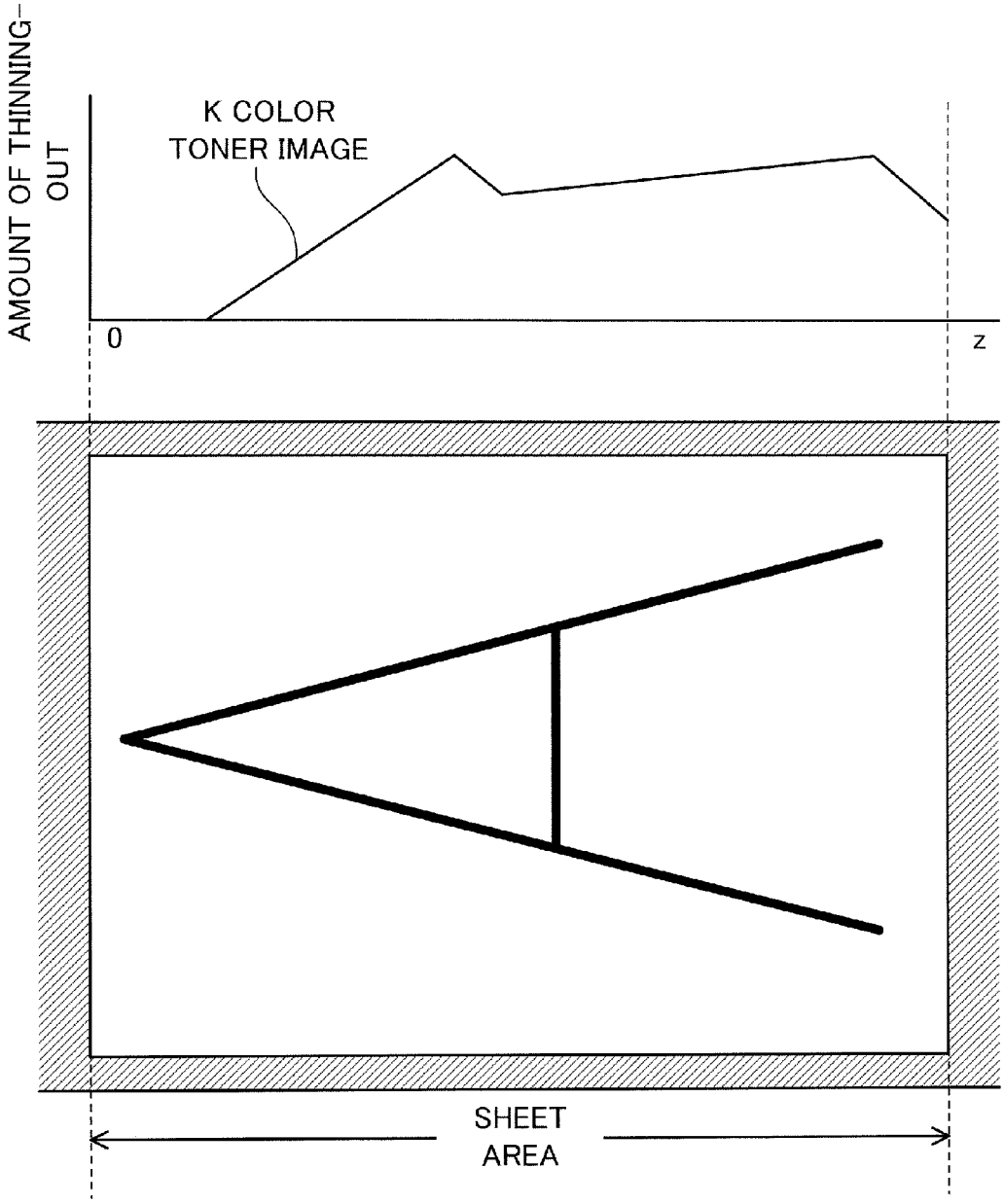
FIG. 12 is a diagram showing an example of a correspondence between a position in the slow scan direction in the K color toner image and the amount of thinning-out.
Figure 13:
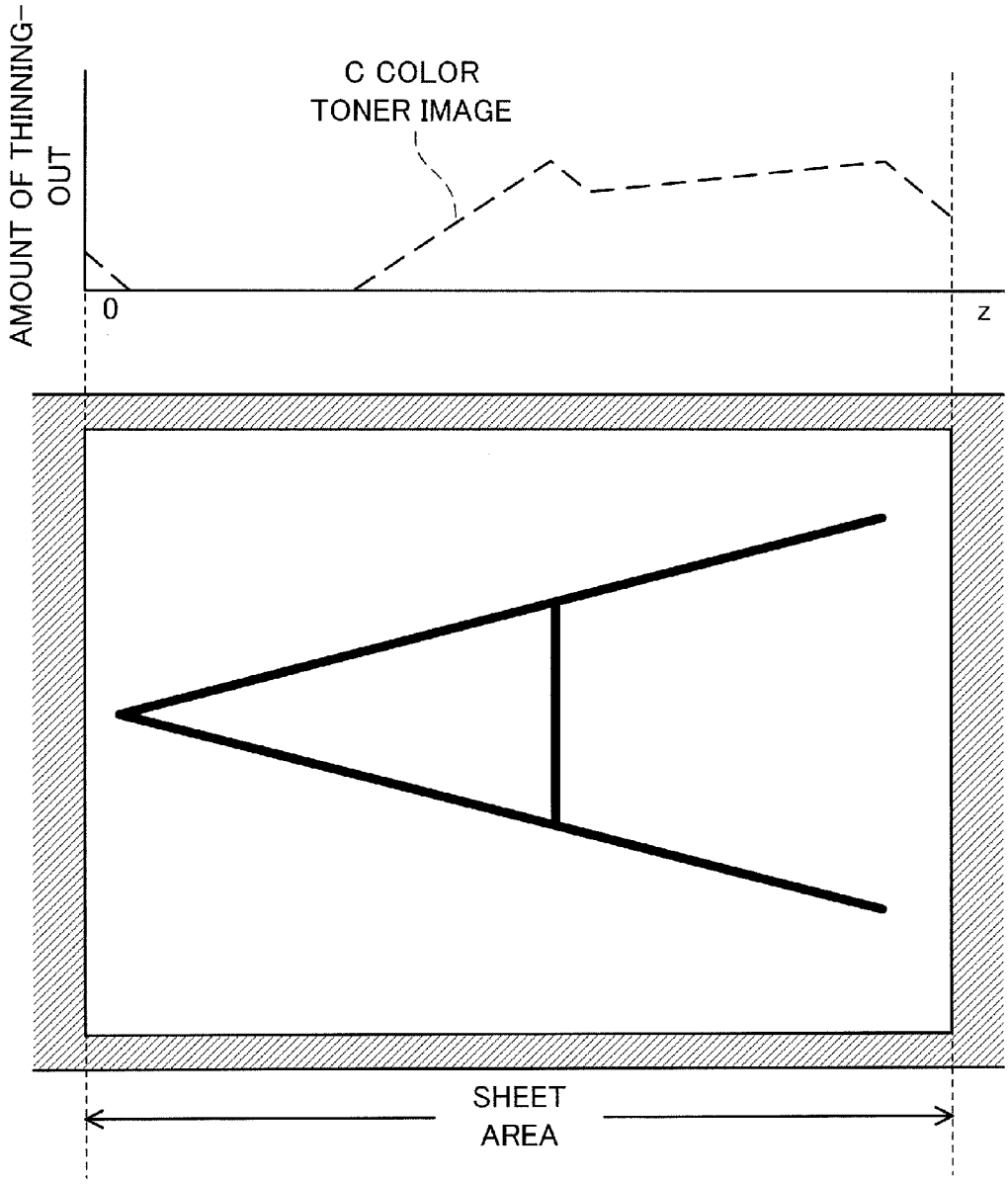
FIG. 13 is a diagram showing an example of a correspondence between a position in the slow scan direction in the C color toner image and the amount of thinning-out.
Figure 14:
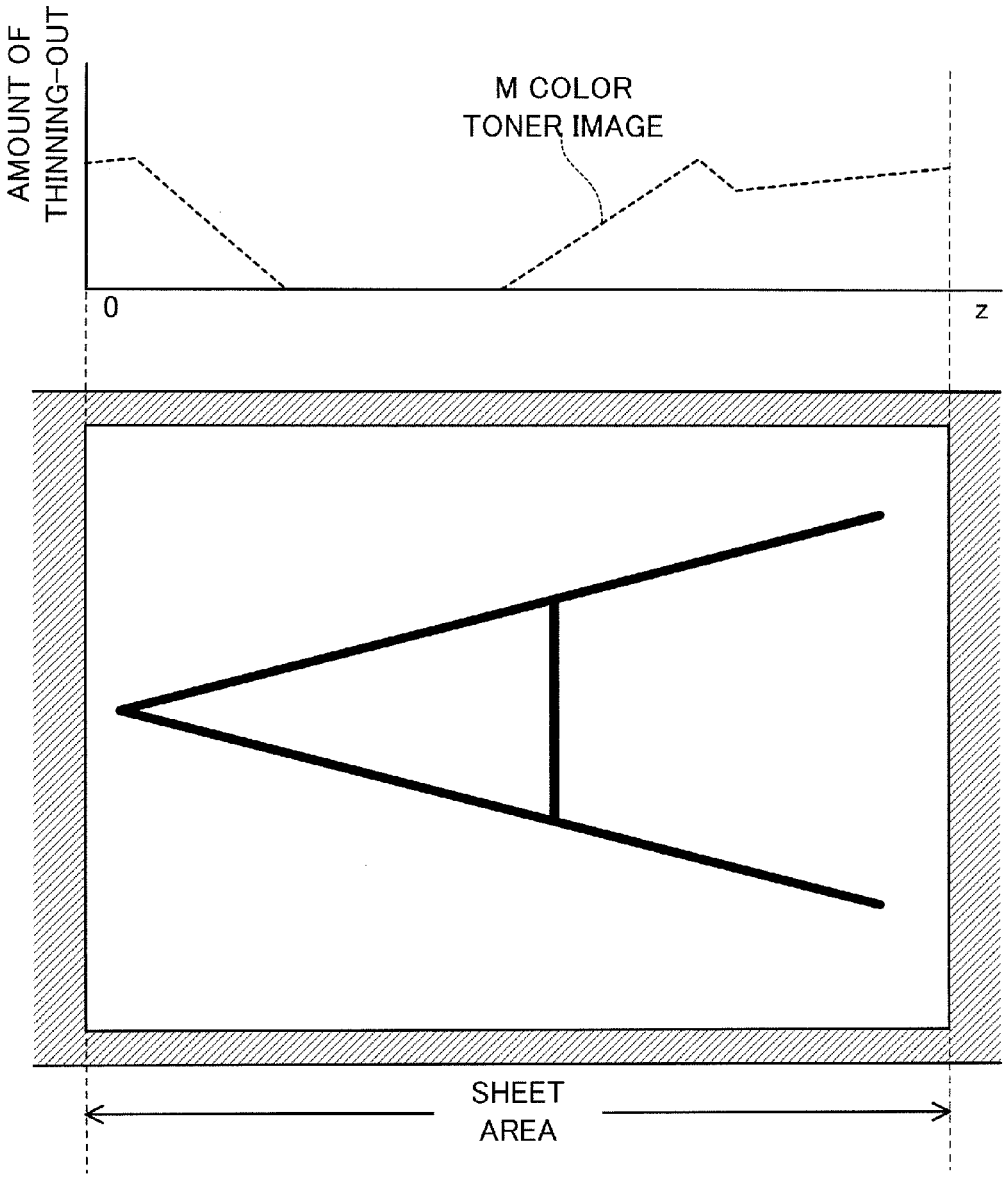
FIG. 14 is a diagram showing an example of a correspondence between a position in the slow scan direction in the M color toner image and the amount of thinning-out.
Figure 15:
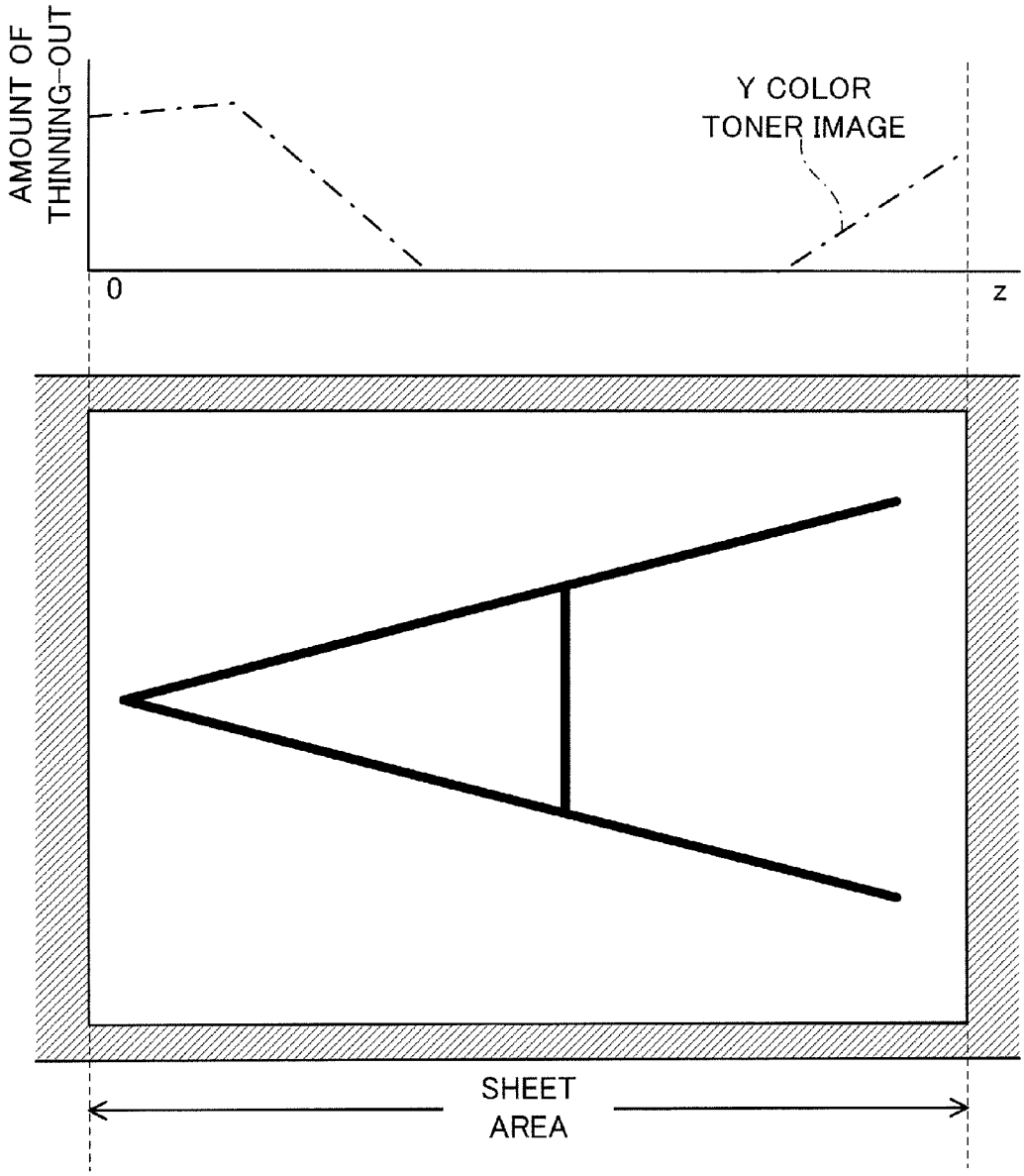
FIG. 15 is a diagram showing an example of a correspondence between a position in the slow scan direction in the Y color toner image and the amount of thinning-out.

Here, FIG. 12 is a diagram showing an example of a correspondence between a position (area) z in the slow scan direction in the K color toner image and the amount of thinning-out. FIG. 13 is a diagram showing an example of a correspondence between a position z in the slow scan direction in the C color toner image and the amount of thinning-out. FIG. 14 is a diagram showing an example of a correspondence between a position z in the slow scan direction in the M color toner image and the amount of thinning-out. FIG. 15 is a diagram showing an example of a correspondence between a position z in the slow scan direction in the Y color toner image and the amount of thinning-out. The correspondences, shown in FIGS. 12 to 15, between the positions z in the slow scan direction in the color toner images and the respective amounts of thinning-out are for a paper type P1, particular humidity (for example, humidity H1) and particular temperature (for example, temperature T1) inside the image forming apparatus 1, for example.

Then, the correspondences between the positions z in the slow scan direction in the color toner images (electrostatic latent images) and the amounts of thinning-out for each of multiple paper types P1 to Pn (n: integer) of the sheet P are stored in tables in the memory of the image processing unit 22. Furthermore, tables for multiple combinations of temperature and humidity inside the image forming apparatus 1 for each of the paper types P1 to Pn are stored. The image processing unit 22 reads out, from the memory, a table to be used for each of the color toner images on the basis of the paper type being used, humidity detected by the humidity sensor 66, and temperature detected by the temperature sensor 67. Then, by use of the table read from the memory, the image processing unit 22 executes image processing for each color while performing the thinning-out processing in the slow scan direction by the amount of thinning-out corresponding to the position z in the slow scan direction in each of the color toner images.

Note that, when the moving velocity Vb of the intermediate transfer belt 41 becomes slower than the design value Vb0, the image processing unit 22 performs image processing to interpolate pixel rows in the slow scan direction. In this case as well, tables showing correspondences between the positions z in the slow scan direction and the amounts of interpolation for the color toner images are stored in the memory of the image processing unit 22. The image processing unit 22 reads out, from the memory, a table to be used for each of the color toner images on the basis of the paper type being used, humidity detected by the humidity sensor 66 and temperature detected by the temperature sensor 67. Then, by use of the table read from the memory, the image processing unit 22 executes image processing for each color while performing interpolation processing in the slow scan direction by the amount of interpolation corresponding to the position z in the slow scan direction in each of the color toner images.

<Description of Arrangement of Pixels to be Interpolated and Thinned Out>

Incidentally, there is a case where a part of the image or the like becomes outstandingly visible when the image processing unit 22 performs, on each of the color toner images, the interpolation processing in the slow scan direction corresponding to the position z in the slow scan direction. In addition, there is a case where a thin-line like image disappears or becomes hardly visible when the image processing unit 22 performs the thinning-out processing in the slow scan direction on each of the color toner images.

In this respect, when performing the interpolation processing or the thinning-out processing in the slow scan direction corresponding to the position z in the slow scan direction on each of the color toner images, the image processing unit 22 adds or deletes a pixel at a position in accordance with a predetermined rule.

Figure 16A:
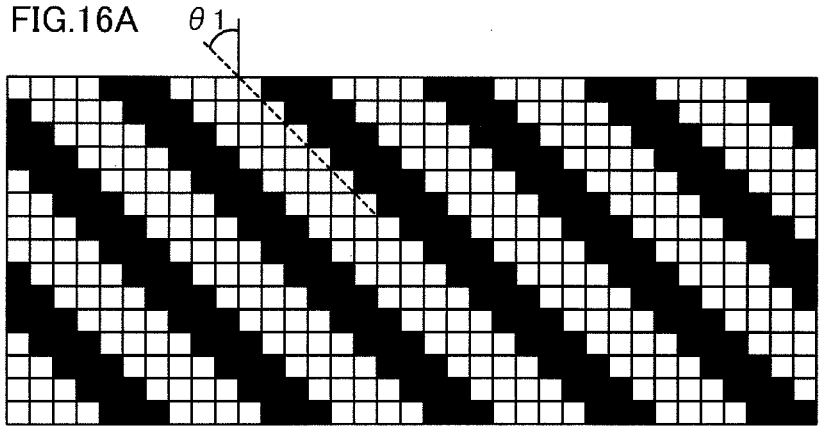
FIGS. 16A to 16C are diagrams for explaining processing for adding (interpolating) pixels in an image.
Figure 16B:
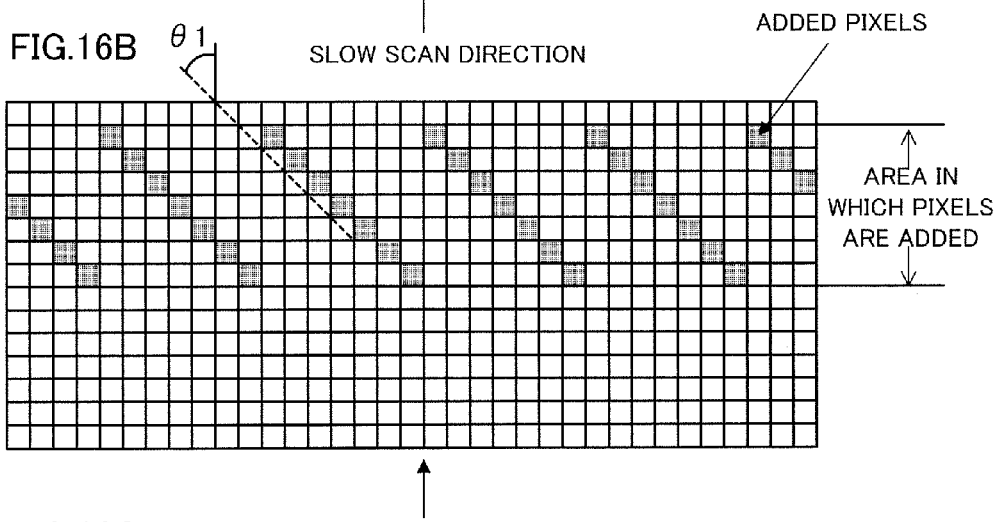
Figure 16C:
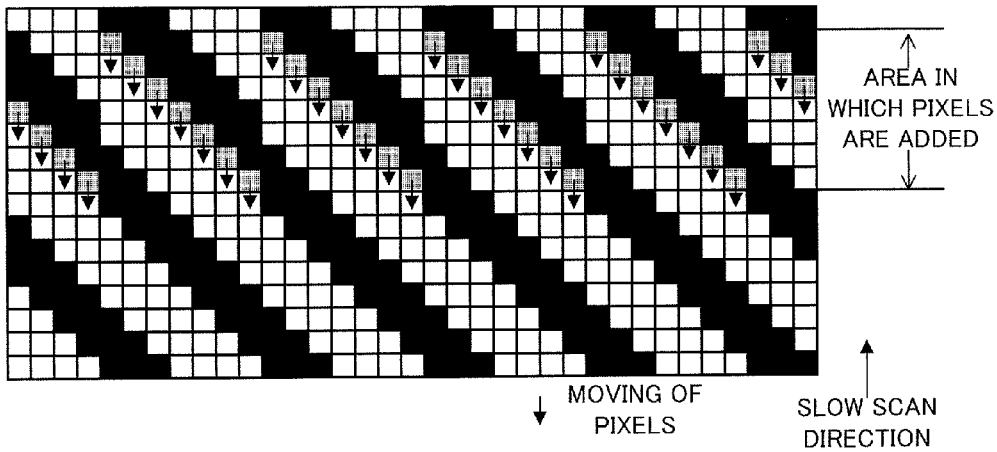

FIGS. 16A to 16C are diagrams for explaining processing for adding (interpolating) pixels in an image. FIGS. 16A to 16C show a case where one pixel is added in the slow scan direction. Specifically, FIG. 16A shows an image before the processing for interpolating pixels is performed; FIG. 16B shows arrangement positions of the pixels to be interpolated; and FIG. 16C shows the image after the processing for interpolating the pixels is performed.

As shown in FIG. 16B, the pixels to be interpolated are arranged at positions each shifted in the slow scan direction by one pixel periodically for each of the predetermined number of pixels in the fast scan direction. Moreover, a screen angle θ1 in this case is set to be equal to a screen angle θ1 of the image.

Then, as shown in FIG. 16C, when the pixels are interpolated at the arrangement positions shown in FIG. 16B, pixels on the downstream side in the slow scan direction with respect to the interpolated pixels are arranged at positions shifted by one pixel each on the downstream side in the slow scan direction. Note that, an arrow in the FIG. 16C shows the moving direction of the pixels of the original image.

As described, the area in which pixels are added spreads in a wider area in the slow scan direction, because the pixels shifted by one pixel each in the slow scan direction are interpolated as shown in FIG. 16B. Thus, the area in which the pixels are interpolated is prevented from becoming outstandingly visible.

Figure 17A:
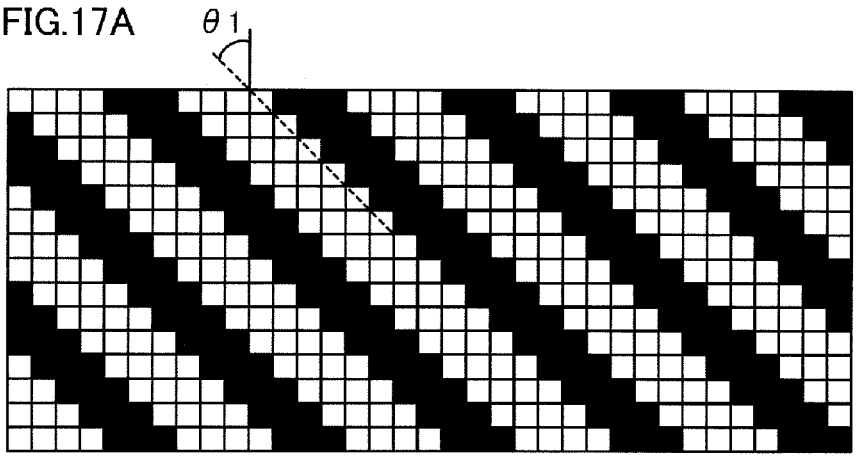
FIGS. 17A to 17C are diagrams for explaining processing for deleting (thinning out) pixels from an image.
Figure 17B:
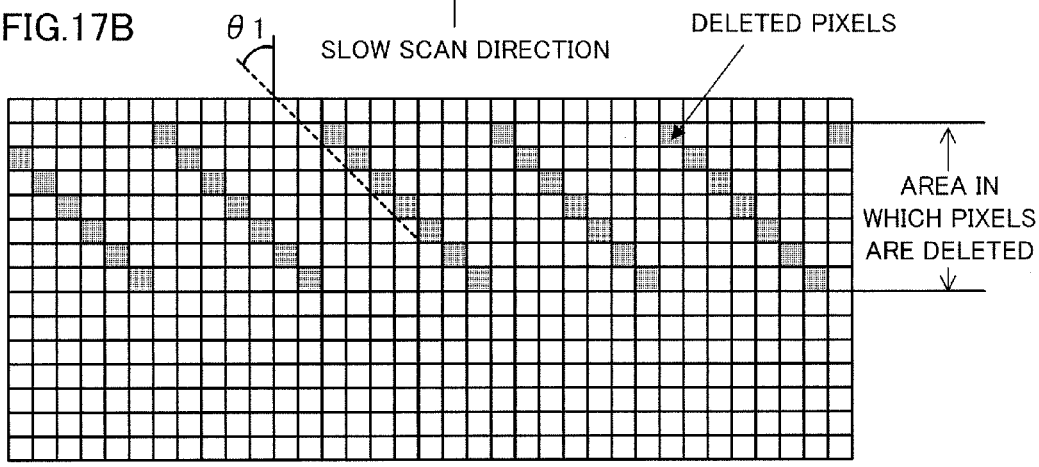
Figure 17C:
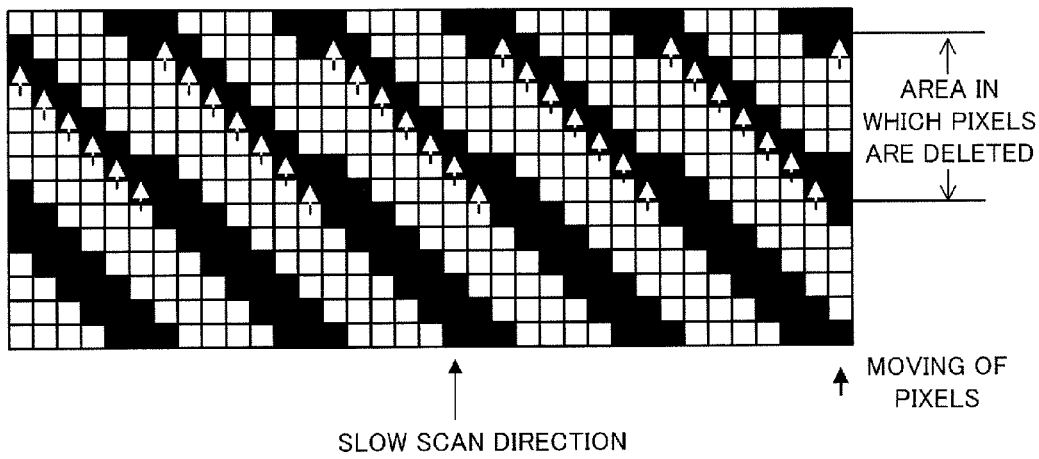

Next, FIGS. 17A to 17C are diagrams for explaining processing for deleting (thinning out) pixels from an image. FIGS. 17A to 17C show a case where one pixel is deleted in the slow scan direction. Specifically, FIG. 17A shows an image before the processing for thinning out pixels is performed; FIG. 17B shows arrangement positions of the pixels to be thinned out; and FIG. 17C shows the image after the processing for thinning out the pixels is performed.

As shown in FIG. 17B, the pixels to be thinned out are arranged at positions each shifted in the slow scan direction by one pixel periodically for each of the predetermined number of pixels in the fast scan direction, as in the case shown in FIGS. 16A to 16C. Moreover, the screen angle θ1 in this case is set to be equal to the screen angle θ1 of the image.

Then, as shown in FIG. 17C, when the pixels are thinned out at the arrangement positions shown in FIG. 17B, pixels on the downstream side in the slow scan direction with respect to the thinned out pixels are arranged at positions shifted by one pixel each on the upstream side in the slow scan direction. Note that, an arrow in the FIG. 17C shows the moving direction of the pixels of the original image.

As described, the area in which pixels are deleted spreads in a wider area in the slow scan direction, because the pixels shifted by one pixel each in the slow scan direction are thinned out as shown in FIG. 17B. Thus, the area in which the pixels are deleted is prevented from disappearing or becoming hardly visible.

In the examples shown in FIGS. 16A to 16C and 17A to 17C, the arrangement positions of the pixels to be interpolated or thinned out are set to be equal to the screen angle θ1 of the image. However, when such setting is used, the pixels to be interpolated or thinned out and the pixels of the original image interfere with each other, and interference fringes appear in some cases, for example, in the image after the processing for interpolating or thinning out pixels is performed.

In this respect, the screen angle, the screen period, the number of screen lines, the type of screen and the like for the pixels to be interpolated or thinned out may be set to be different from those for the pixels of the original image.

Figure 18A:
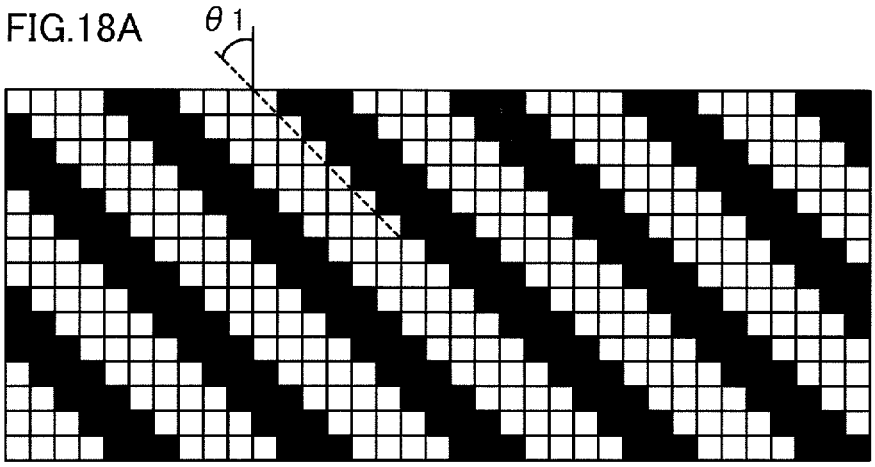
FIGS. 18A to 18C are diagrams for explaining a case where processing for adding (interpolating) pixels is performed where a screen angle of pixels to be interpolated is set to be different from the screen angle of the pixels of the original image.
Figure 18B:
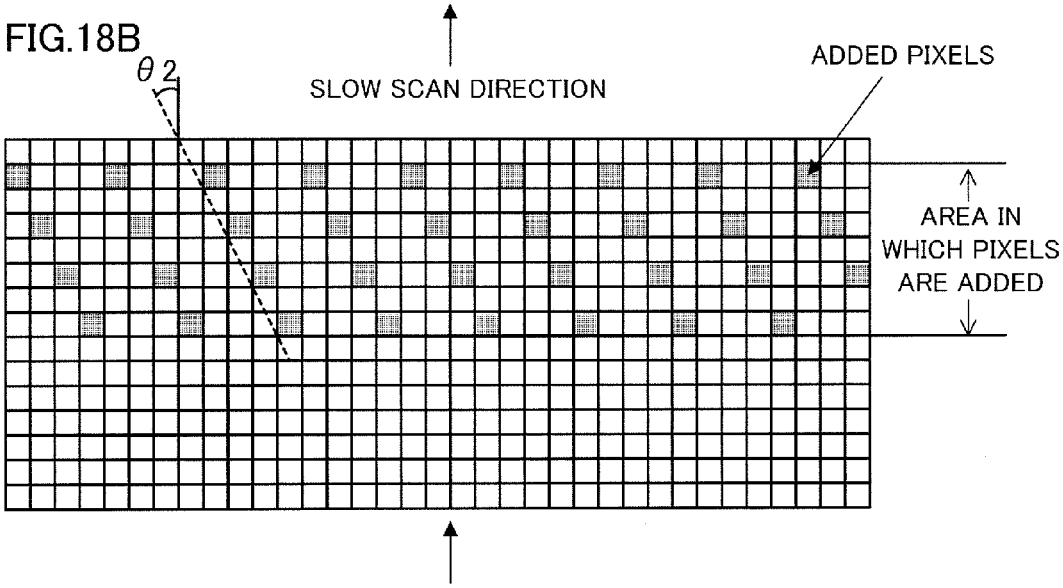
Figure 18C:
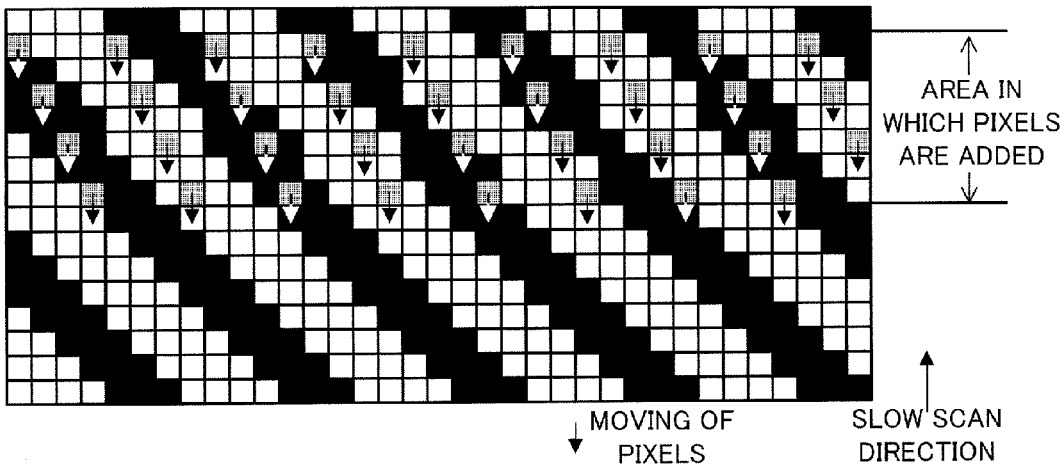

FIGS. 18A to 18C are diagrams for explaining a case where processing for adding (interpolating) pixels is performed where a screen angle θ2 of pixels to be interpolated is set to be different from the screen angle θ1 of the pixels of the original image.

FIGS. 18A to 18C also show a case where one pixel is added in the slow scan direction. Specifically, FIG. 18A shows an image before the processing for interpolating pixels is performed; FIG. 18B shows arrangement positions of the pixels to be interpolated; and FIG. 18C shows the image after the processing for interpolating the pixels is performed.

As shown in FIG. 18B, the pixels to be interpolated are arranged at positions each shifted in the slow scan direction by two pixels periodically for each of the predetermined number of pixels in the fast scan direction. Moreover, the screen angle θ2 in this case is set to be different from the screen angle θ1 of the image.

Then, as shown in FIG. 18C, when the pixels are interpolated at the arrangement positions shown in FIG. 18B, pixels on the downstream side in the slow scan direction with respect to the interpolated pixels are arranged at positions shifted by two pixels each on the downstream side in the slow scan direction. Note that, an arrow in the FIG. 18C shows the moving direction of the pixels of the original image.

As described, the area in which pixels are added spreads in a wider area in the slow scan direction, because the pixels shifted by two pixels each in the slow scan direction are interpolated as shown in FIG. 18B. Thus, the area in which the pixels are interpolated is prevented from becoming outstandingly visible. Moreover, since the screen angles are different, the occurrence of interference fringes in the image after the interpolation processing is performed is prevented.

Figure 19A:
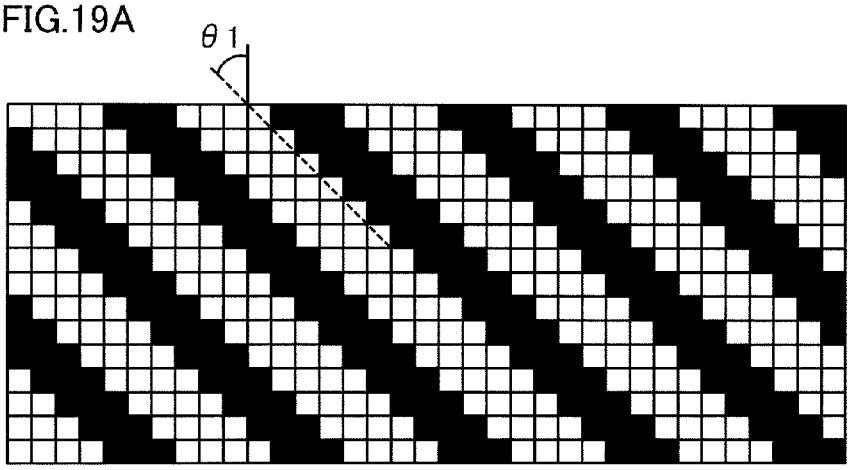
FIGS. 19A to 19C are diagrams for explaining a case where processing for deleting (thinning out) pixels is performed where the screen angle of pixels to be interpolated is set to be different from the screen angle of the pixels of the original image.
Figure 19B:
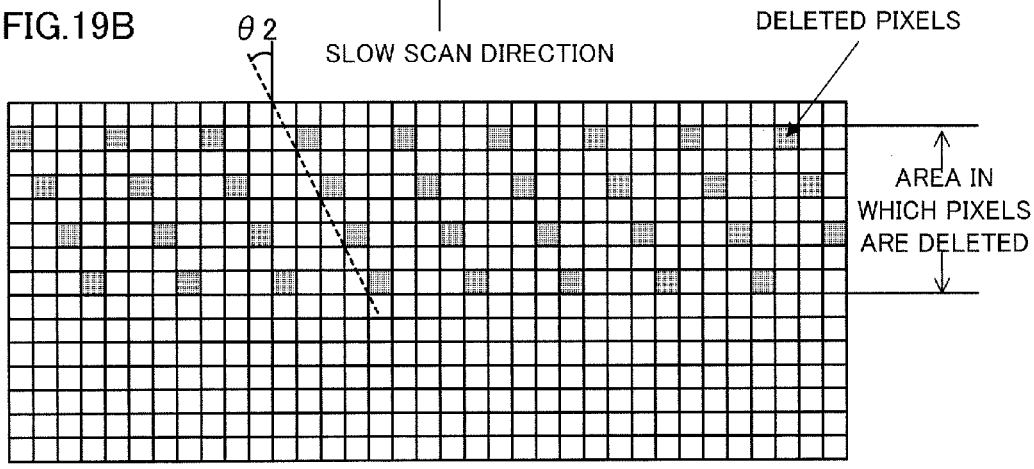
Figure 19C:
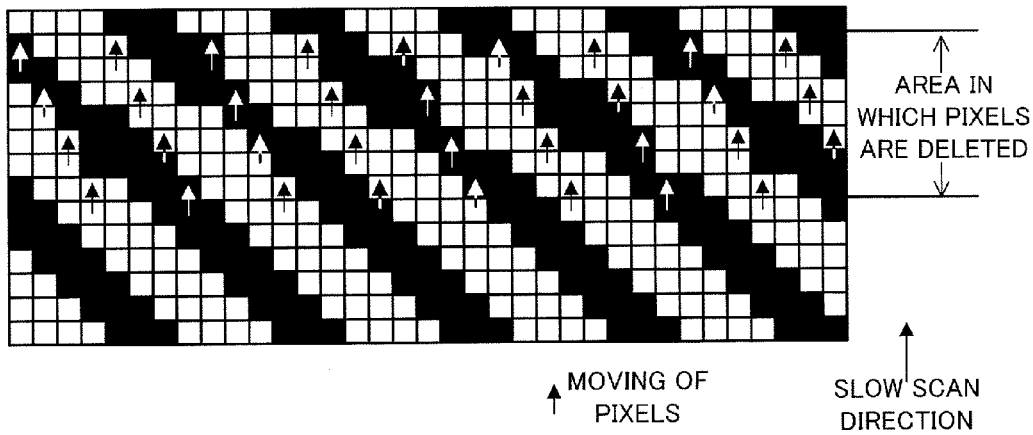

FIGS. 19A to 19C are diagrams for explaining a case where processing for deleting (thinning out) pixels is performed where the screen angle θ2 of pixels to be interpolated is set to be different from the screen angle θ1 of the pixels of the original image.

FIGS. 19A to 19C show a case where one pixel is deleted in the slow scan direction. Specifically, FIG. 19A shows an image before the processing for thinning out pixels is performed; FIG. 19B shows arrangement positions of the pixels to be thinned out; and FIG. 19C shows the image after the processing for thinning out the pixels is performed.

As shown in FIG. 19B, the pixels to be thinned out are arranged at positions each shifted in the slow scan direction by two pixels periodically for each of the predetermined number of pixels in the fast scan direction as in the case shown in FIGS. 18A to 18C. Moreover, the screen angle θ2 in this case is set to be different from the screen angle θ1 of the image.

Then, as shown in FIG. 19C, when the pixels are thinned out at the arrangement positions shown in FIG. 19B, pixels on the downstream side in the slow scan direction with respect to the thinned out pixels are arranged at positions shifted by two pixels each on the upstream side in the slow scan direction. Note that, an arrow in the FIG. 19C shows the moving direction of the pixels of the original image.

As described, the area in which pixels are deleted spreads in a wider area in the slow scan direction, because the pixels shifted by two pixels each in the slow scan direction are thinned out as shown in FIG. 19B. Thus, the area in which the pixels are deleted is prevented from disappearing or becoming hardly visible. Moreover, since the screen angles are different, the occurrence of interference fringes in the image after the deletion processing is performed is prevented.

<Description of Hardware Configuration of Image Processor>

Figure 20:
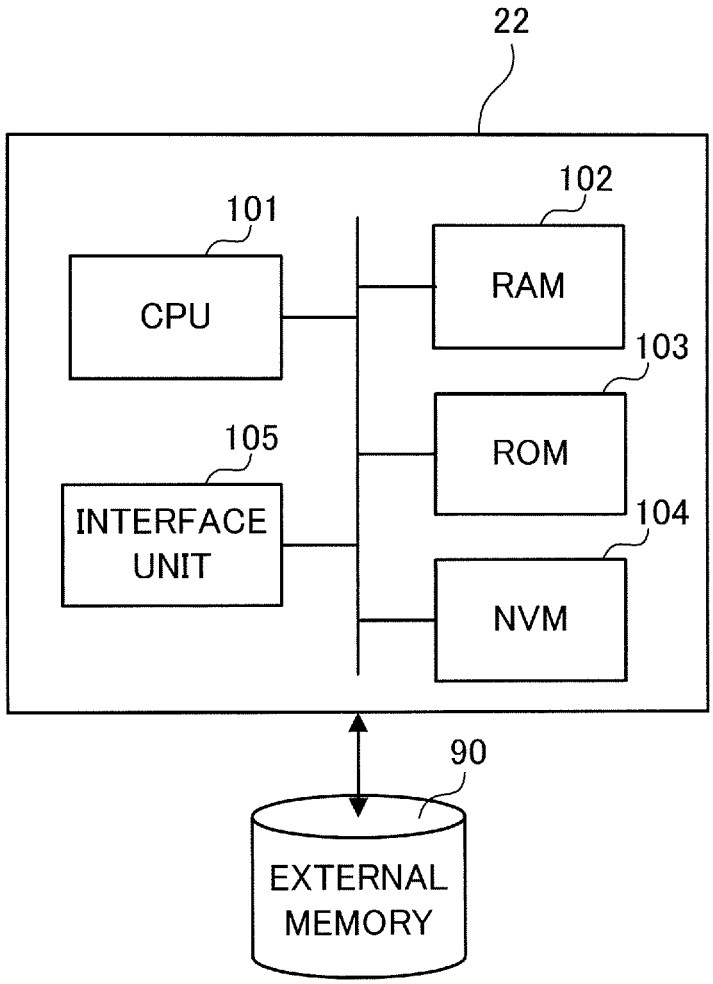
FIG. 20 is a diagram showing a hardware configuration of the image processing unit.

Next, FIG. 20 is a diagram showing a hardware configuration of the image processing unit 22. As shown in FIG. 20, the image processing unit 22 includes: a CPU 101; a RAM 102; a ROM 103; a Non-Volatile Memory (NVM) 104, such as an electrically erasable programmable read-only memory (EEPROM) and a flash memory; and an interface unit 105. The CPU 101 executes digital computing processing in accordance with a predetermined program, for executing image processing for adding (interpolating) or deleting (thinning out) pixels in the slow scan direction to or from each color electrostatic latent image (each color toner image). The RAM 102 stores, therein, the program and the like executed by the CPU 101. The ROM 103 stores, therein, data such as setting values and the like used by the program and the like executed by the CPU 101. The NVM 104 is rewritable and capable of retaining data therein even when power supply is lost. The interface unit 105 controls an input and an output of a signal from or to each component connected to the image processing unit 22.

The tables that describe the correspondences between the positions z in the slow scan direction in the aforementioned color toner images and the amounts of thinning-out are stored in the NVM 104 as an example of the storage unit.

As has been described above, in the image forming apparatus 1 of the present exemplary embodiment, in order that the sizes, in the slow scan direction, of the color toner images forming the same image area on the intermediate transfer belt 41 may coincide with or approximate each other, pixel rows in the slow scan direction are added (interpolated) to or deleted (thinned out) from each of the color toner images formed on the photoconductor drums 31 of the image forming units 30, in accordance with the amount of change in the moving velocity Vb of the intermediate transfer belt 41. Thereby, the amount of color shifting in the image is reduced in the image forming apparatus 1 in which various types of sheets P are used.

Note that, although the descriptions above are provided in the case of the image forming apparatus using the intermediate transfer belt 41 as an example of the toner image holding member, the present invention is applied in the same manner to an image forming apparatus of a so-called IOI (image on image) method in which color toner images are sequentially superimposed, for example, on a belt-like photoconductor body as an example of a toner image holding member, then, developed and collectively transferred onto a sheet, as described above.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image processing unit that acquires image data, performs image processing on the image data, and generates pieces of color image data that are pieces of image data for respective colors;

a plurality of toner image forming units that each form an electrostatic latent image on the basis of one of the pieces of color image data generated by the image processing unit, that each develop the electrostatic latent image thus formed, and that each form a color toner image, the electrostatic latent image having pixel rows arranged in a slow scan direction, the pixel rows each including pixels aligned in a fast scan direction; and a toner image holding member that moves while holding each color toner image formed by each of the plurality of toner image forming units, wherein the image processing unit performs, on each of the pieces of color image data, image processing in which at least one of the pixel rows is added to or deleted from a position, in the slow scan direction, of the electrostatic latent image to be formed on the basis of each of the pieces of color image data, the number of the pixel rows added or deleted corresponding to the amount of change in a moving velocity of the toner image holding member when each color toner image formed at the position is held by the toner image holding member.

2. The image forming apparatus according to claim 1, wherein the image processing unit performs, on each of the pieces of the color image data, the image processing to set arrangement positions of pixels to be performed any one of adding and deleting, in accordance with a rule set in advance.

3. The image forming apparatus according to claim 1, further comprising a storage unit that stores a correspondence between the position, in the slow scan direction, of the electrostatic latent image and the number of the pixel rows to be performed any one of adding and deleting for a type of a recording medium onto which each color toner image held by the toner image holding member are transferred, wherein the image processing unit performs, on each of the pieces of color image data, the image processing that is any one of adding and deleting the pixel rows for the position, in the slow scan direction, of the electrostatic latent image on the basis of the correspondence stored in the storage unit.

4. The image forming apparatus according to claim 3, wherein the storage unit stores the correspondence for a type of the recording medium, for each of a plurality of combinations of humidity and temperature inside the image forming apparatus.

5. An image processor comprising:

an acquisition unit that acquires image data;

an image processing unit that performs image processing on the image data acquired by the acquisition unit, and generates pieces of color image data that are pieces of image data for respective colors; and a transmission unit that transmits, to a plurality of toner image forming units, the pieces of color image data on which image processing is performed, the plurality of toner image forming units that each form an electrostatic latent image on the basis of one of the pieces of color image data, that each develop the electrostatic latent image thus formed, and that each form a color toner image, the electrostatic latent image having pixel rows arranged in a slow scan direction, the pixel rows each including pixels aligned in a fast scan direction, wherein the image processing unit performs, on each of the pieces of color image data, image processing in which at least one of the pixel rows is added to or deleted from a position, in the slow scan direction, of the electrostatic latent image to be formed by each of the toner image forming units, the number of the pixel rows added or deleted corresponding to the amount of change in a moving velocity of a toner image holding member when each color toner image formed at the position is held by the toner image holding member, the toner image holding member moving while holding each color toner image.

6. The image processor according to claim 5, wherein the image processing unit performs, on each of the pieces of the color image data, the image processing to set arrangement positions of pixels to be performed any one of adding and deleting, in accordance with a rule set in advance.

7. The image processor according to claim 5, further comprising:

a storage unit that stores a correspondence between the position, in the slow scan direction, of the electrostatic latent image and the number of the pixel rows to be performed any one of adding and deleting for a type of a recording medium onto which each color toner image held by the toner image holding member are transferred, wherein the image processing unit performs, on each of the pieces of color image data, the image processing that is any one of adding and deleting the pixel rows for the position, in the slow scan direction, of the electrostatic latent image on the basis of the correspondence stored in the storage unit.

8. The image processor according to claim 7, wherein the storage unit stores the correspondence for a type of the recording medium, for each of a plurality of combinations of humidity and temperature inside the image processor.

9. An image processing method for an image forming apparatus including an image processing unit that acquires image data, performs image processing on the image data, and generates pieces of color image data that are pieces of image data for respective colors; a plurality of toner image forming units that each form an electrostatic latent image on the basis of one of the pieces of color image data generated by the image processing unit, that each develop the electrostatic latent image thus formed, and that each form a color toner image, the electrostatic latent image having pixel rows arranged in a slow scan direction, the pixel rows each including pixels aligned in a fast scan direction; and a toner image holding member that moves while holding each color toner image formed by each of the plurality of toner image forming units; the image processing method comprising:

performing, on each of the pieces of color image data, image processing in which at least one of the pixel rows is added to or deleted from a position, in the slow scan direction, of the electrostatic latent image to be formed on the basis of each of the pieces of color image data, the number of the pixel rows added or deleted corresponding to the amount of change in a moving velocity of the toner image holding member when each color toner image formed at the position is held by the toner image holding member.

10. A non-transitory computer readable medium storing a program that causes a computer to execute a process for image processing, the process comprising:

acquiring image data;

generating pieces of color image data that are pieces of image data for respective colors from the image data thus acquired; and performing, on each of the pieces of color image data, image processing in which at least one of the pixel rows is added to or deleted from a position, in a slow scan direction, of an electrostatic latent image, the electrostatic latent image being formed on the basis of one of the pieces of color image data thus generated, and having pixel rows arranged in the slow scan direction, the pixel rows each including pixels aligned in a fast scan direction, the number of the pixel rows for the image processing added or deleted corresponding to the amount of change in a moving velocity of a toner image holding member when color toner images for respective colors formed at the position is held by the toner image holding member, the toner image holding member moving while holding each of the color toner images.

* * * * *